US005576744A

United States Patent [19]

Niikura et al.

[11] Patent Number: 5,576,744

[45] Date of Patent: Nov. 19, 1996

[54] RECORDING APPARATUS AND METHOD COMPENSATING FOR VARYING GAP BETWEEN RECORDING HEAD AND RECORDING MEDIUM

[75] Inventors: Takeji Niikura, Kawasaki; Masasumi Nagashima, Yokohama; Yasushi Koike, Tokyo, all of Japan

[73] Assignee: Canon Kabushiki Kaisha, Tokyo, Japan

[21] Appl. No.: 86,111

[22] Filed: Jul. 6, 1993

[30] Foreign Application Priority Data

| | | | |
|---|---|---|---|
| Jul. 6, 1992 | [JP] | Japan | 4-178110 |
| May 28, 1993 | [JP] | Japan | 5-127083 |

[51] Int. Cl.[6] ..... B41J 29/38

[52] U.S. Cl. ..... 347/14; 347/8

[58] Field of Search ..... 347/8, 9, 13, 14, 347/17, 19, 41, 23, 44; 400/55, 56, 58, 59

[56] References Cited

U.S. PATENT DOCUMENTS

| | | | |
|---|---|---|---|
| 4,328,504 | 5/1982 | Weber et al. | 347/14 |
| 4,435,674 | 3/1984 | Hevenor et al. | 347/14 |
| 4,847,638 | 7/1989 | Moriyama | 347/14 |
| 4,907,013 | 3/1990 | Hubbard et al. | 347/14 |
| 4,977,459 | 12/1990 | Ebinuma et al. | 347/14 |
| 5,157,411 | 10/1992 | Takekoshi et al. | 347/13 |

FOREIGN PATENT DOCUMENTS

| | | | |
|---|---|---|---|
| 56-92070 | 7/1981 | Japan | 347/19 |
| 57-110460 | 7/1982 | Japan | 347/19 |
| 60-104335 | 6/1985 | Japan | 347/44 |
| 63-044548 | 2/1988 | Japan . | |
| 63-265649 | 11/1988 | Japan | 400/55 |
| 1-75248 | 3/1989 | Japan | 347/8 |
| 2-172755 | 7/1990 | Japan | 347/19 |
| 2-214664 | 8/1990 | Japan . | |
| 2-241776 | 9/1990 | Japan | 400/55 |
| 3-156249 | 7/1991 | Japan . | |
| 36-227652 | 10/1991 | Japan | 347/14 |
| 4-006549 | 1/1992 | Japan . | |
| 59-59458 | 4/1994 | Japan | 347/19 |

*Primary Examiner*—John E. Barlow, Jr.

*Attorney, Agent, or Firm*—Fitzpatrick, Cella, Harper & Scinto

[57] ABSTRACT

A recording apparatus for recording information with a recording head having a plurality of recording elements while keeping a designated distance between the recording head and a recording medium has an information acquisition device for acquiring distance information between the plurality of recording elements and the recording medium, a correction device for providing a correction value for a recording timing for each recording element of the recording head in accordance with the distance information acquired by the information acquisition device, and a control device for controlling the recording head to record at a timing corrected with the correction value provided by the correction device.

9 Claims, 36 Drawing Sheets

CORRECTION TABLE

FLOATING VALUE (mm) / CORRECTION VALUE (μsec)

| | | RECORDING POSITION | | (FROM TOP EDGE OF THE RECORDING SHEET ~ mm) | | | | |
|---|---|---|---|---|---|---|---|---|
| | | 0 ~ 10 | 10 ~ | ~200 | 200~210 | 210 ~ 220 | 220 ~ 230 | --- |
| SHEET A | SIZED A4 | 0/0 | 0/ | 0/0 | 0/0 | 0.05/35 | 0.05/35 | |
| | B4 | 0/0 | 0/ | / 35 | 0.05/35 | 0.05/35 | 0.05/35 | |
| SHEET B | A4 | 0/0 | 0/0 | /0 | 0/0 | 0/0 | 0/0 | |
| | B4 | 0/0 | 0/0 | /0 | 0/0 | 0/0 | 0/0 | |
| SHEET C | A4 | 0/0 | 0/0 | | 0/0 | 0.05/35 | 0.05/35 | |
| | B4 | 0/0 | 0/0 | | 0.1/70 | 0.1/70 | 0.1/70 | |

FIG.14

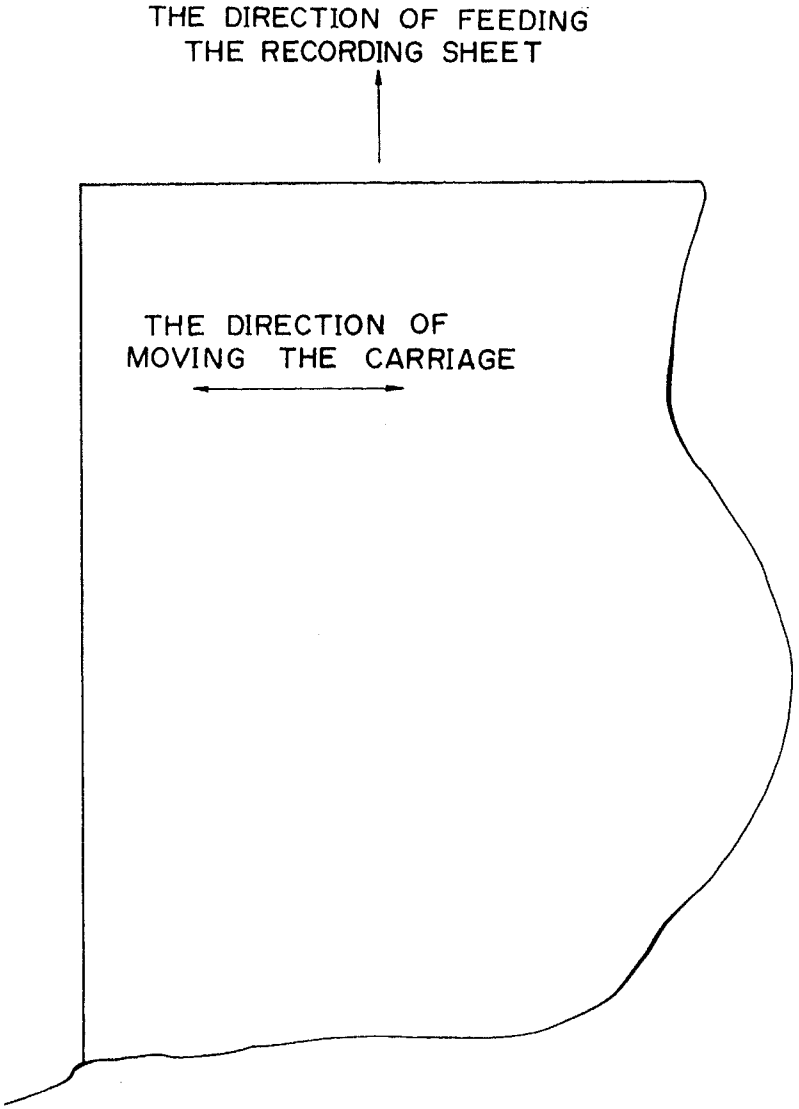
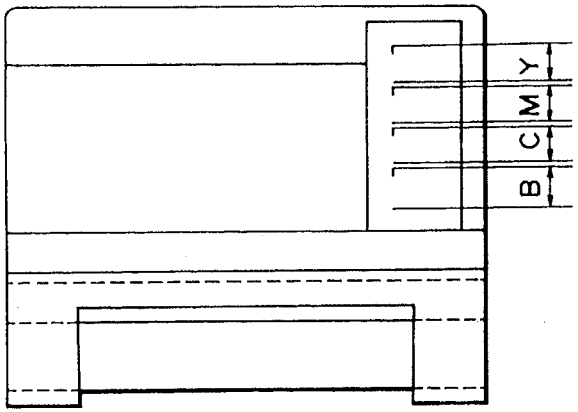
FIG. 20

EXAMPLE OF CORRECTION TABLE { SHEET A, A4 SIZED / ENVIRONMENT 15 ~ 25°C / 40 ~ 80%

FLOATING VALUE (mm) / CORRECTION VALUE (μsec)

| | | THE RECORDING POSITION (FROM LEFT EDGE OF THE RECORDING SHEET ~ mm) | | | | |
|---|---|---|---|---|---|---|
| | | 0 ~ 5 | 5 ~ 10 | 10 ~ 15 | 15 ~ 20 | 20 ~ 25 |
| THE PRINT DUTY OF THE PREVIOUS LINES IS 30% OR LESS | THE PRINT DUTY OF THE CURRENT LINE IS 30% OR LESS | 0 / 0 | 0 / 0 | 0.05 / 35 | 0.05 / 35 | 0.05 / 35 |
| | 30 TO 60% | 0 / 0 | 0 / 0 | 0.05 / 35 | 0.1 / 70 | 0.05 / 35 |
| | 60 TO 100% | 0 / 0 | 0.05 / 35 | 0.1 / 70 | 0.15 / 105 | 0.1 / 70 |
| THE PRINT DUTY OF THE PREVIOUS LINES IS 30 TO 60% | THE PRINT DUTY OF THE CURRENT LINE IS 30% OR LESS | 0 / 0 | 0 / 0 | 0.05 / 35 | 0.1 / 70 | 0.05 / 35 |
| | | | | | | |

FIG. 24

RECORDING APPARATUS AND METHOD COMPENSATING FOR VARYING GAP BETWEEN RECORDING HEAD AND RECORDING MEDIUM

BACKGROUND OF THE INVENTION

1. Field of the Invention

The present invention relates to an ink jet recording apparatus and method for recording images, for example, by ejecting ink on a recording medium.

2. Description of the Prior Art/Related Art

In a serial-type recording apparatus, in which images are recorded on a recording medium by scanning the recording head in the main-scan direction and, moving the recording medium in the sub-scan direction defined to be vertical to the main-scan direction, after setting the recording medium at a designated recording position, images are recorded with the recording head mounted on the carriage moving in the width direction on the recording medium, which is designated "main scanning", and every time after completing the recording operation for the single line in the width direction, the recording medium is fed in a designated length in the direction vertical to the above mentioned width direction, which is designated "pitch feed", and thus, by repeating the main scanning operation and the pitch feed operation, the recording of the image on the sheet of the recording medium is performed.

Among the recording apparatus using the serial type recording operation mentioned above, an ink jet recording apparatus using ink jet method records images by ejecting ink on the surface of the recording medium from the recording head, which enables the reduction of the size of the recording head and can establish highly precise recording images with high speed.

In addition, the ink jet recording apparatus has several advantageous aspects such as lower running cost due to the capability of recording on general purpose paper sheets without special chemical surface processing and as lower noise level due to using non-impact recording mechanism, and as the capability of printing colored images with multiple color ink.

Specifically, the recording head used with ink jet method in which ink droplets are ejected by thermal energy can be fabricated by semiconductor fabrication processing such as etching, vacuum evaporation and spattering which are used for forming electro-thermal conversion devices, electrodes, fluid walls and upper plates, each defined on the semiconductor substrate, and ultimately, in the recording head fabricated in this manner, fine-pitched and highly-integrated liquid paths and orifices can be easily formed, and thus, the size of the recording head can be further reduced.

In the above described ink jet recording apparatus, fine-pitched orifices are arranged. In case that air voids and dusts come into the inside the orifice, or that the recording head can not be used for normal recording operations due to the increase of viscosity of ink as the solvent of ink evaporates, ejection recovering operations are performed by flushing off ink staying inside the orifice in order to remove the above described factors for making ink fail to be ejected.

In such an ink jet recording apparatus as described above, the recording medium is wound at a feed roller, and fed by feed rollers and an extraction roller. FIG. 1 shows the cross sectional view of the ink jet recording apparatus, in which what is shown is the feeding state of the recording medium 1. The recording medium 1 is wound at a carrier roller 33, and moved forward by the rotating movement of the carrier roller 33 and a feed roller 39 between which the recording medium 1 is inserted. When the recording medium 1 reaches a platen 34, the recording operation is established by placing the recording medium against a head cartridge 9 and ejecting ink from the orifices of the recording head. After completing the recording operations, the recording medium 1 is moved by the extraction roller 41 and a spur 42 and finally, extracted from an extraction port 8 of a housing case 7. In FIG. 1, the head cartridge 9 is mounted on a carriage 11 which is moved along a guide shaft 23 extended in the main-scan direction.

In the prior art ink jet recording apparatus, at the state shown in FIG. 1 in which the edge of the recording medium 1 comes near the extraction roller 41, the recording medium 1 is placed on the line defined by the common tangent line between the carrier roller 33 and the extraction roller 41 and the recording medium 1 faces against the recording head 9. However, as the recording operations proceed, the edge of the recording medium 1 bends behind the normal position, and as a result, the portion of the recording medium 1 at the platen 34 is apart from the platen 34 and moves closer to the recording head.

FIG. 2 shows the state in which the recording medium 1 bends behind its normal position. In FIG. 2, the portion of the recording medium 1 in the neighboring area of the recording head is displaced left from its ordinary position relative to the recording head, the extraction roller 41 and the feed roller 39. That is, the distance between the surface of the recording head and the uppermost orifice of the recording head and the distance between the surface of the recording head and the lowermost orifice of the recording head are not identical to each other.

The bad effect of the change of the distance between the surface of the recording medium 1 and the recording head over the recording performance is described by referring to FIG. 3. In FIG. 3, Vi is the velocity of ink ejected from the orifice, Vc is the velocity of the carriage moving in the main-scan direction, and Vr is a combination vector of Vi and Vc, and θr is the angle defined between Vc and Vr.

$$
\begin{aligned}
|Vr|^2 &= |Vi + Vc|^2 \\
&= |Vi|^2 + |Vc|^2 + 2|Vi||Vc|\cos 90^\circ \\
&= |Vi|^2 + |Vc|^2 \\
|Vi|^2 &= |Vr - Vc|^2 \\
&= |Vr|^2 + |Vc|^2 + 2|Vr||Vc|\cos\theta r
\end{aligned}
$$

In the above mentioned ink jet recording apparatus, $$
\begin{aligned}
Vi &= 10 \text{ m/sec, and} \\
Vc &= 64 \text{ cps} \times 48 \text{ dots} \times 1/360 \text{ inches} \\
&= 216.7 \text{ mm/sec}
\end{aligned}
$$

wherein "cps" means character/sec, "48 dots" corresponds to the width per character and the dot number per inch is 360.

In addition, the gap between the recording head 9 and the recording medium 1 is determined to be 1 mm. In case that the portion of the recording medium facing to the uppermost orifice of the recording head is not apart from the platen and that the gap between the portion of the recording medium facing to the lowermost orifice (or sixty fourth orifice) of the recording head and the platen (floating value) is supposed to be 0.4 mm, the recording position displacement dx is estimated as in, $$\begin{aligned} dx &= 0.4 \times \tan(90 - \theta r) \\ &= 0.00867 \text{ mm} \\ &= 8.67\ \mu\text{m}. \end{aligned}$$

And furthermore, in addition to the above condition, suppose that the angle defined between the orifice forming face and the surface of the recording medium is not zero, that is, the angle θ. The angle θ is defined as shown in FIG. 4. In the previous case, the angle θ is defined to be zero. In similar way, the mathematical and geometrical relationship between Vi, Vc, Vr and θr establishes that $$\begin{aligned} |Vr|^2 &= |Vi + Vc|^2 \\ & \quad |Vi|^2 + |Vc|^2 + 2|Vi||Vc|\cos\theta \\ |Vi|^2 &= |Vr - Vc|^2 \\ & \quad |Vr|^2 + |Vc|^2 + 2|Vr||Vc|\cos\theta r \end{aligned}$$

In this example, the angle θ is defined to be 100 degrees, supposing that the portion of the recording medium facing to the orifices located at the upper part of the recording head is not apart from the platen and that the distance between the portion of the recording medium facing to the 64th orifice located at the lower part of the recording head and the surface of the platen (floating value) is supposed to be 0.4 mm, the recording position displacement dx is estimated as in $$\begin{aligned} dx &= 0.4 \times \tan|90 - \theta r| \\ &= 0.06173 \text{ mm} \\ &= 61.73\ \mu\text{m}. \end{aligned}$$

And thus, what is concluded is that the larger the angle between the orifice forming face and the surface of the recording medium, the larger the effect of the gap between the surface of the platen and the surface of the recording medium over the recording position displacement.

This effect is extremely emerged in case that the recording medium is naturally curly, or that the strong but flexible material is used for the recording medium. In addition, another problem occurs as that the longer the length of the edge of the recording medium in the sub-scan direction, the larger this effect.

In addition, processing precision and fabricating error of hardware components of the recording apparatus may affect the occurrence of the recording position displacement which means that the expected relative position between the recording head and the recording medium is not established in the actually assembled apparatus.

By ejecting ink on the recording medium, the portion of the recording medium absorbing the projected ink expands. In such a case, as flat portions and expanded portions are distributed randomly on the recording medium in accordance with the recording operation for forming recording images, convex parts and concave parts are formed on the recording medium. So far, not only the convex and concave parts are distributed in the sub-scan direction along which the recording medium is fed forward, but also convex and concave parts are distributed in the man-scan direction along which the carriage having the recording head moves vertically facing against the recording medium.

Thus, the height of convex and concave parts is subject to the quantity of ink projected on the recording medium; the overall quantity of ink projected on the recording medium for forming visual images and for color printings using multiple 3 to 4 tones of colored ink is larger than that for recording character fonts, and hence, as the height of convex parts is larger in such cases, satisfactory level for establishing qualified recording images can not be obtained in spite of requesting high quality recording images for visual images and multiple color printings.

In general, in the ink jet recording apparatus, the diameter of the ink dot projected on the surface of the recording medium is subject to several factors; the kind of recording media, such as used materials, sizes and thicknesses, and surface finish professing; the characteristics of individual recording heads; operational environments of the recording apparatus; the history of recording operations; and the amount of ink remained in the ink storage, expected level of recording quality can not be obtained. In few special cases but in the worst case, the ink can not be ejected from the orifice, and the high-quality recording images can not be obtained. In general, these problems are recognized to be improved.

From another view of the improvement of the overall recording apparatus in its operational environment, there is a problem in the recording position displacement between the images recorded on the previous lines and the images to be recorded on the current line.

In the prior art recording apparatus as described above, even in case that the ink can not be ejected from the recording head, the drive signal for requesting the recording head to eject ink is still continuously supplied to the designated electro-thermal conversion devices at the ejection heater part of the recording head. If this supply of drive signals to the ejection heater part of the recording head continues too long, thermal energy to be removed in accordance with the ejection of ink is stored at the ejection heater part, which may cause a bad effect over its neighboring orifices operated under normal conditions and even cause the disconnection of wires for transmission of drive signals to the recording heads, and thus, these problems related to the performance of the recording head itself should be solved.

And furthermore, even if the drive signal for requesting the recording head to eject ink is disconnected only when the drive signal is directed to the orifice in which what is observed is that the ink can not be ejected, the recorded image may contain white or blank spots corresponding to orifices from which ink can not be ejected, and therefore, what is remained as a problem is that designated recorded images can not be obtained.

SUMMARY OF THE INVENTION

In order to solve problems in the prior art systems, an object of the present invention is to provide a recording apparatus for preventing the recording position displacement caused by the relative position between the recording medium and the recording head and for preventing the reduction of the quality of recorded images due to the ink ejection failure at some orifices of the recording head.

Another object of the present invention is to provide a recording method for preventing the recording position displacement caused by the relative position between the recording medium and the recording head and for preventing the reduction of the quality of recorded images due to the ink ejection failure at some orifices of the recording head.

That is, the primary object of the present invention is to provide a recording apparatus for preventing the recording position displacement caused by the relative position between the recording medium and the recording head.

Another object of the present invention is to provide a recording apparatus for preventing the recording position displacement caused by the relative position between the recording medium and the recording head.

Another object of the present invention is to provide a recording apparatus for preventing the damage of the recording head caused by the ink ejection failure by means that the drive signal for requesting the recording head to eject ink is disconnected in case that the ink ejection failure is detected at the recording head.

Another object of the present invention is to provide a recording apparatus for establishing a high-quality recorded image even in case of disconnecting the drive signal for requesting the recording head to eject ink at the orifice in which the ink ejection failure is detected.

A further object of the present invention is provide a recording method for preventing the recording position displacement caused by the relative position between the recording medium and the recording head.

A further object of the present invention is to provide a recording method for preventing the damage of the recording head caused by the ink ejection failure by means that the drive signal for requesting the recording head to eject ink is disconnected in case that the ink ejection failure is detected at the recording head.

A still further object of the present invention is for establishing a high-quality recorded image even in case of disconnecting the drive signal for requesting the recording head to eject ink at the orifice in which the ink ejection failure is detected.

In the first aspect of the present invention, a recording apparatus for recording information with a recording head having a plurality of recording elements while keeping a designated distance between the recording head and a recording medium comprises:

information acquisition means for acquiring distance information between the plurality of recording elements and the recording medium;

correction means for providing a correction value for a recording timing for each recording element of the recording head in accordance with the distance information acquired by the information acquisition means; and control means for controlling the recording head to record at a timing corrected with the correction value provided by the correction means.

Here, the information acquisition means may acquire distance information based on a position on a recording medium at which the recording head is currently recording information and a size of the recording medium.

The information acquisition means may acquire distance information based on a position on a recording medium at which the recording head is currently recording information, a size of the recording medium and an environment temperature and humidity.

The information acquisition means may have sensor means and acquires distance information by detecting a distance between one of the plurality of recording elements and the recording medium with the sensor means.

The information acquisition means may acquire distance information based on print duty.

The correct ion means may provide a time for shifting a timing for recording at each recording element of the plurality of recording elements.

The correction means may correct a velocity for a drive means for driving a carriage.

The correction means may correct the recording timing based on a correction value obtained from a correction table.

The correction means may correct a distance between each recording element of the plurality recording elements and the recording medium based on the value measured actually by the sensor means.

The correction means may correct the recording timing based on a correction value obtained from a correction table by specifying a print duty up to a previous line, a print duty up to a current recording line, information on an order of repeated path, and a lapse of time after a previous path in the correction table.

The correction means may correct previously a distance between each recording element of the plurality of recording elements and the recording medium in accordance with a thickness of the recording medium.

The plurality of recording elements may be categorized into blocks, each block containing a designated number of recording elements; and acquisition of the distance information, correction of the recording timing, and control of recording in the corrected recording timing are performed at every the block.

The recording head may be an ink jet recording head recording information by ejecting ink.

The recording head may be a recording head ejecting ink by using thermal energy, and the recording head having a thermal energy conversion member for generating thermal energy to be transferred to the ink.

In the second aspect of the present invention, a recording method for recording information with a recording head having a plurality of recording elements while keeping a designated distance between the recording head and a recording medium comprises the steps of:

acquiring distance information between the plurality of recording elements and the recording medium;

providing a correction value for a recording timing for each recording element of the recording head in accordance with the distance information; and controlling the recording head to record at a timing corrected with the correction value.

In the third aspect of the present invention, a recording apparatus for recording information by moving back and forth a carriage having a recording head including a plurality of recording elements comprises:

detection means for detecting a recording state in printing operation; and control means for controlling recording by individual recording elements of the recording head based on the state detected by the detection means.

Here, the detection means may detect the recording state with image recognition means.

The control means may adjust an ejection power and an ejection method corresponding to a change in a diameter of a dot detected by the image recognition means.

The detection means may detect a recording unable state.

The control means may make invalid a drive signal for the recording element for which the recording unable state is detected by the detection means.

The detection means may detect a non-ejection state of ink.

The control means may make invalid an ejection signal directed to an orifice for which a non-ejection state of ink is detected by the detection means.

The control means may be means for controlling variably ink ejection energy.

The control means may increase an amount of ejected ink from at least one orifice adjacent to an orifice for which a non-ejection state of ink is detected by the detection means.

The control means may increase an amount of ejected ink from at least one orifice adjacent to an orifice for which a non-ejection state of ink is detected by the detection means.

The control means may report a non-ejection state of ink in accordance with a detection of a non-ejection state of ink by the detection means, and further selects whether printing is made to continue with an ejection condition being modified or printing is interrupted and ejection recovering operation is made to start.

The control means may perform forced recovering ejection in accordance with a detection of a non-ejection state of ink by the detection means.

In the fourth aspect of the present invention, a recording method for recording information by moving back and forth a carriage having a recording head having a plurality of recording elements comprises the step of:

while detecting a recording state during printing operation, controlling the recording head in accordance with the recording state detected by the detection means.

Based on the dislocation or the shift of the recording image detected by the detection means, or the relative position between the recording medium and the recording head, the correction values for the recording timing of the recording head and the ejection control of the recording head are estimated by the correction means, and the recording operation is controlled by the estimated correction values.

In case that the state that the recording operation can not be possible is detected by the recording state detection means, the above objectives can be attained by means that the correction means makes invalid the drive signal directed to the recording head in which the state that the recording operation can not be possible is detected.

In addition, in the ink jet recording apparatus of the present invention, by forming the correction means as a means for controlling the ink ejection energy at an arbitrary value, what can be avoided is the degradation of the quality of the recording image by means that the orifice from which ink can not be ejected can be restored so that ink may be ejected from the non-ejection orifice or that the quantity of ink ejected from orifices around the non-ejection orifice is made to be increased.

The above and other objects, effects, features and advantages of the present invention will become more apparent from the following description of embodiments thereof taken in conjunction with the accompanying drawings.

BRIEF DESCRIPTION OF DRAWINGS

FIG. 14 is a diagram showing an example of the correction table related to the first embodiment of the present invention;

FIG. 20 is a schematic illustration showing an example of the structure for the color recording head;

FIG. 24 is a diagram showing an example of the correction table;

FIG. 34 shows a character recorded in a normal recording condition; FIG. 35 shows a character recorded with the recording head having a non-ejection orifice at the dot #22; and FIG. 36 shows a character composed of recorded dots including dots with their diameters being enlarged by 30% adjacent to the dot #22;

DETAILED DESCRIPTION OF PREFERRED EMBODIMENTS

[Embodiment 1]

In this embodiment, what is explained is a printer having an ink jet recording head ejecting ink by using thermal energy. The recording head used in this kind of printer can be easily fabricated so as to have a high density liquid path arrangement (a high density orifice layout) by means that thermal conversion devices, electrodes, fluid route walls and upper plates are formed by thin film made on a substrate through semiconductor fabrication processing such as etching, vacuum evaporation and spattering, and thus, the size of the printer can be further reduced than printers using another kind of ink jet recording head.

In the recording head using ink jet recording method in which ink is ejected by using thermal energy, orifices from which ink is ejected are arranged in parallel and ink is ejected by generating bubbles in ink by the heater for the orifice corresponding to the individual recording position.

<Structure of Printer>

Figure 5:
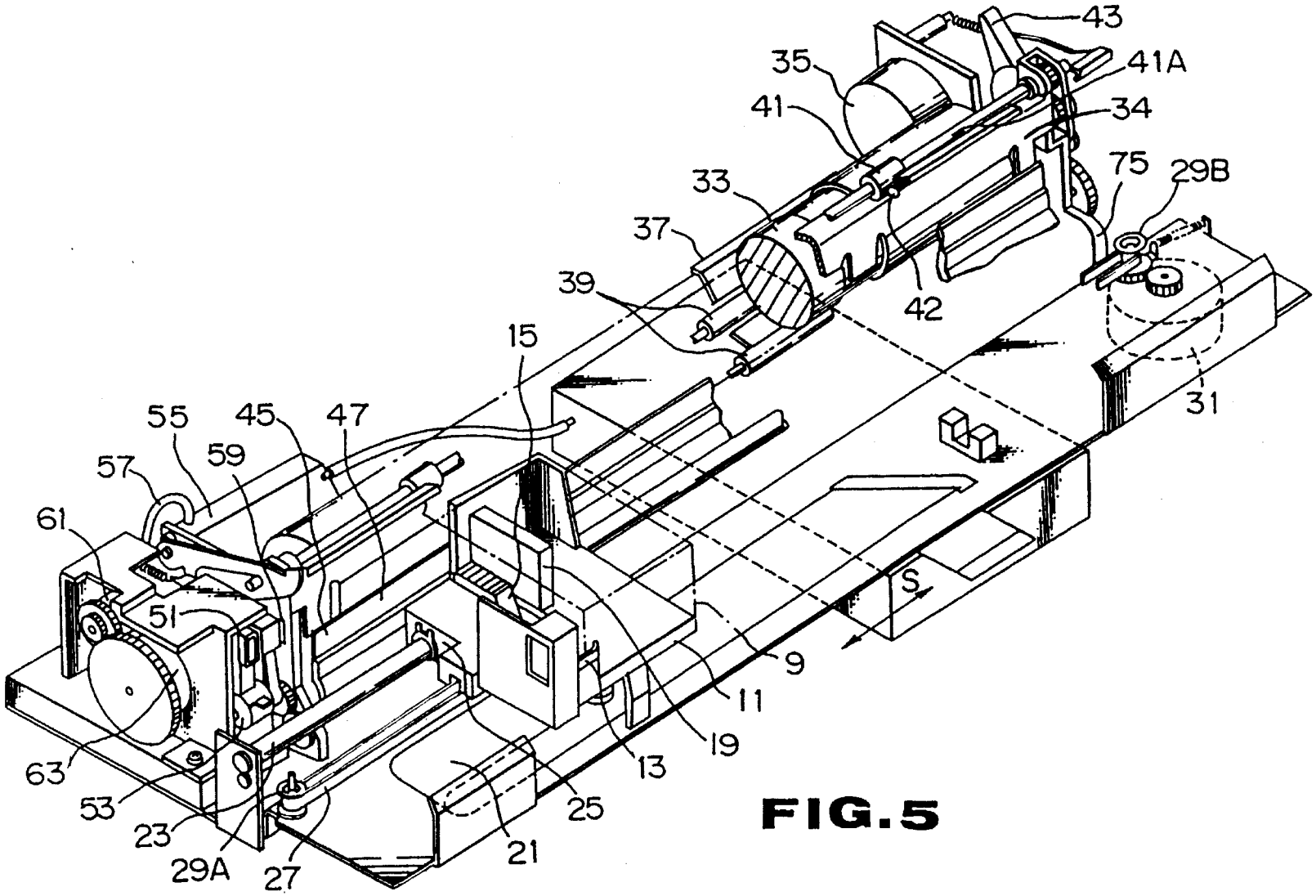
FIG. 5 is an schematic perspective view of an embodiment of the ink jet recording apparatus according to the present invention.

FIG. 5 is a perspective view showing an example of the structure of the recording operation part of the ink jet recording apparatus. In FIG. 5, a head cartridge 9 has an ink jet recording head, a carriage 11 mounts the head cartridge 9 for scanning it in the direction S. A hook 13 fixes the head cartridge 9 at the carriage 11, the hook 13 is operated by a lever 15. A support plate 19 supports an electric connection part for the head cartridge 9. A flexible cable (FPC) 21 connects the electric connection part with a control part in the recording apparatus. In the recording apparatus of this embodiment, 64 orifices are formed in parallel at the recording head.

A guide shaft 23 limits the movement of the carriage 11 in the direction S, which is inserted through a bearing 25 of the carriage 11. A timing belt 27 on which the carriage 11 is fixed transmits the drive force for moving the carriage 11 with itself, and is extended between the pulley 29A and 29B installed at the both ends part of the recording apparatus. The drive force generated by a carriage motor 31 is transmitted to the pulley 29B through a transmission mechanism such as gears.

A carrier roller 33 driven by a carrier motor 35 defines the surface of the recording medium (or designated recording sheet below) made of paper and so on and carries the recording sheet. A paper pan 37 guides the recording medium from a paper supply tray to the recording position, and a feed roller 39 placed below the carrier roller forms the sheet supply path of the recording medium and presses the recording medium toward the carrier roller 33 for carrying the recording medium. A sheet discharge roller 41 placed downstream of the recording position in the sheet supply path discharges the recording medium toward the sheet discharge port not shown. A spur 42 facing to the sheet discharge roller 41 presses the recording medium toward the roller 41 for moving the recording sheet between the sheet discharge roller 41 and the spur 42 as they rotate. A reset lever 43 is used for releasing the feed roller 39, the press plate 45 and the spur 42 from pressing the recording medium used when inserting the recording medium at a designated recording position.

The paper pan 37 has a front part 45. A scale 47 is defined at the front part 45 of the paper pan which allows to read out a printing position and a specific setting position of the recording head.

A cap 51 formed with elastic material such as rubber faces the orifice forming face of the recording head located at the home position and is supported so that the cap may touch the recording head. The cap 51 is used for protecting the recording head not in the recording operation and for the ejection recovering operation of the recording head. The ejection recovering operation includes an operation for removing ink which can not be used for recording because the ink contains bubbles and dust and the viscosity of ink increases, which may be attained by ejecting ink from all the orifices by driving energy generating devices used for ink ejection and installed inside the individual orifices, which is designated "preliminary ejection", and an operation for removing forcibly ink remained in the orifices by another method other than driving energy generating devices. In either case, any factor related to the ink ejection failure may be removed.

A pump is used for generating a sucking force for the forced removal of ink remaining in the orifices as well as for sucking ink captured in the cap 51 after the preliminary ejection or the forced removal operation of ink. A waste ink tank stores waste ink sucked by the pump 53, and a tube 57 connects the pump 53 with the waste ink tank 55.

A blade 59 wipes the orifice forming face of the recording head, which is supported so as to be moved between the position for wiping the orifice forming face of the recording head at the nearest position to the recording head while the recording head is moving and the position where the blade 59 and the orifice forming face are not contacted and set apart. Reference numeral 61 is a recovering system motor. A cam mechanism 63 to which is transmitted the rotational force from the recovering system motor 61 drives the pump 53 and moves the cap 51 and the blade 59.

Figure 6:
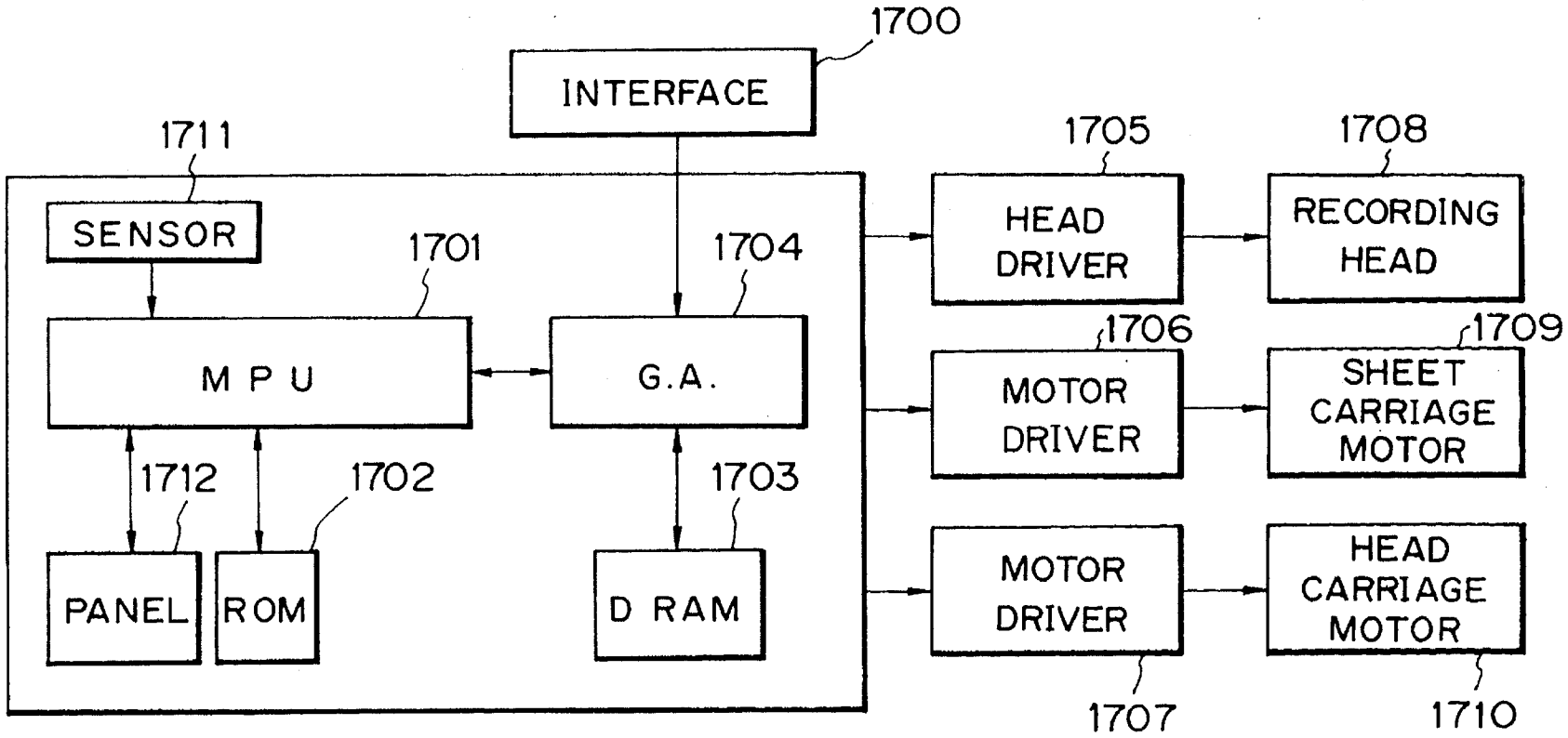
FIG. 6 is a block diagram showing the embodiment of the ink jet recording apparatus in accordance with the present invention.

Now referring to the block diagram shown in FIG. 6, what is described below is the control structure for controlling the recording operation in the recording apparatus described above. In the control circuit shown in FIG. 6, an interface 1700 accepts the recording signal as input, an MPU 1701 controls the procedure defined in the control program stored in a ROM 1702, a program ROM 1702 stores the control program executed by the MPU 1701 whose flowchart is described later, and a dynamic RAM 1703 stores various data including the recording signal and the recording data supplied to the recording head. A gate array 1704 controls the supply of the recording data to a recording head 1708 as well as controlling data transmission among the interface 1700, the MPU 1701 and the RAM 1703. A head carrier motor 1710 carries the recording head 1708, a sheet carrier motor 1709 carries the recording sheet. A head driver 1705 drives the recording head, and motor drivers 1706 and 1707 drive the sheet carrier motor 1709 and the head carrier motor 1710, respectively.

The behavior of the above described control structure is noted as that, at first, when the recording signal is supplied to the interface 1700, the recording signal is converted into the recording data used for printing by the gate array 1704 and the MPU 1701, and that the motor drivers 1706 and 1707 are driven as well as the recording head is driven in accordance with the recording data supplied to the head driver 1705 and thus, recording operations are performed.

In addition to the control structure described above, it may be allowed to install a sensor 1711 for detecting information related to the size of the recording sheet to be supplied to the MPU 1701 and related to the fact that the recording sheet is fed into the recording apparatus, and to install an operation panel 1712 used for reporting the state of the recording apparatus to the operator and accepting the commands directed by the operator.

Figure 7:
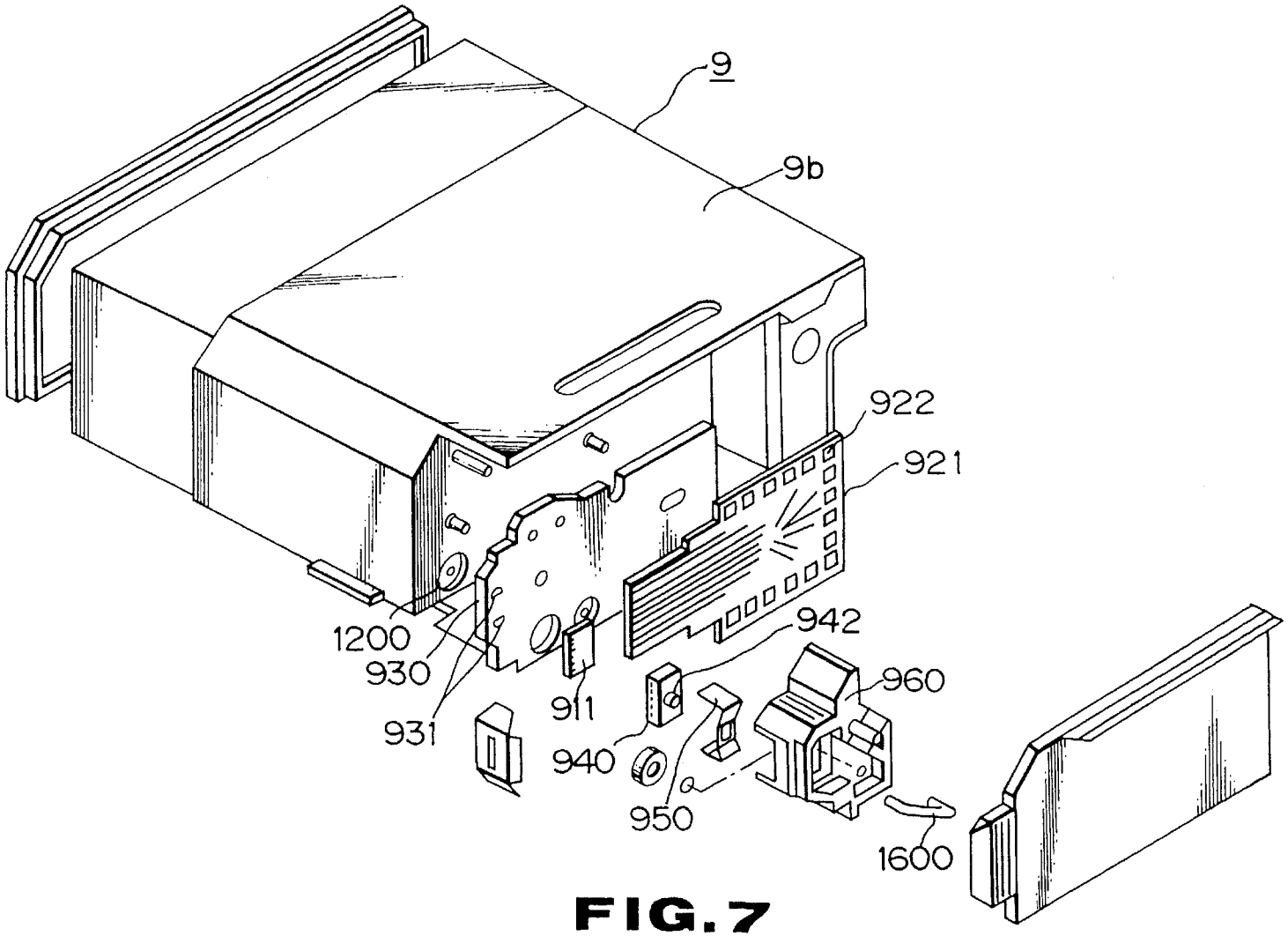
FIG. 7 is an exploded perspective view of the head cartage.

FIG. 7 is an exploded perspective view of the head cartridge 9. A plurality of orifice heaters placed in an array on a Si substrate and electric wiring for supplying electric power to them are defined on a heater board 911. A plurality of nozzles, an orifice plate part having orifices corresponding to individual nozzles, and a common fluid reservoir for storing ink to be supplied to individual nozzles are molded to be integral to an upper plate. Reference numeral 921 is a circuit board, whose one side of wiring is connected to the heater board 911 with wire bonding and so on, and the other side of wiring is connected to a pad 922 to be used for accepting electric signals from the recording apparatus itself. The circuit board 921 and the heater board 911 are bonded with chemical glue on a base plate 930 made of metal.

And furthermore, the heater board 911 and the upper plate 940 are fixed onto the base plate 930 by means that the heater board 911 and the upper plate 940 are made to be caught by a press spring 950 and that the both end parts of the press spring 950 are made to be inserted and fixed in holes 931 of the base plate 930. An ink supply member has an ink supply pipe 1600. The ink supply pipe 1600 connects an ink supply hole 1200 of the ink tank **9*b* and an ink catch port 942 of the upper plate 940. Owing to this structure, the ink route is established from the ink tank 9*b*** to the orifices at the orifice plate part.

Figure 8:
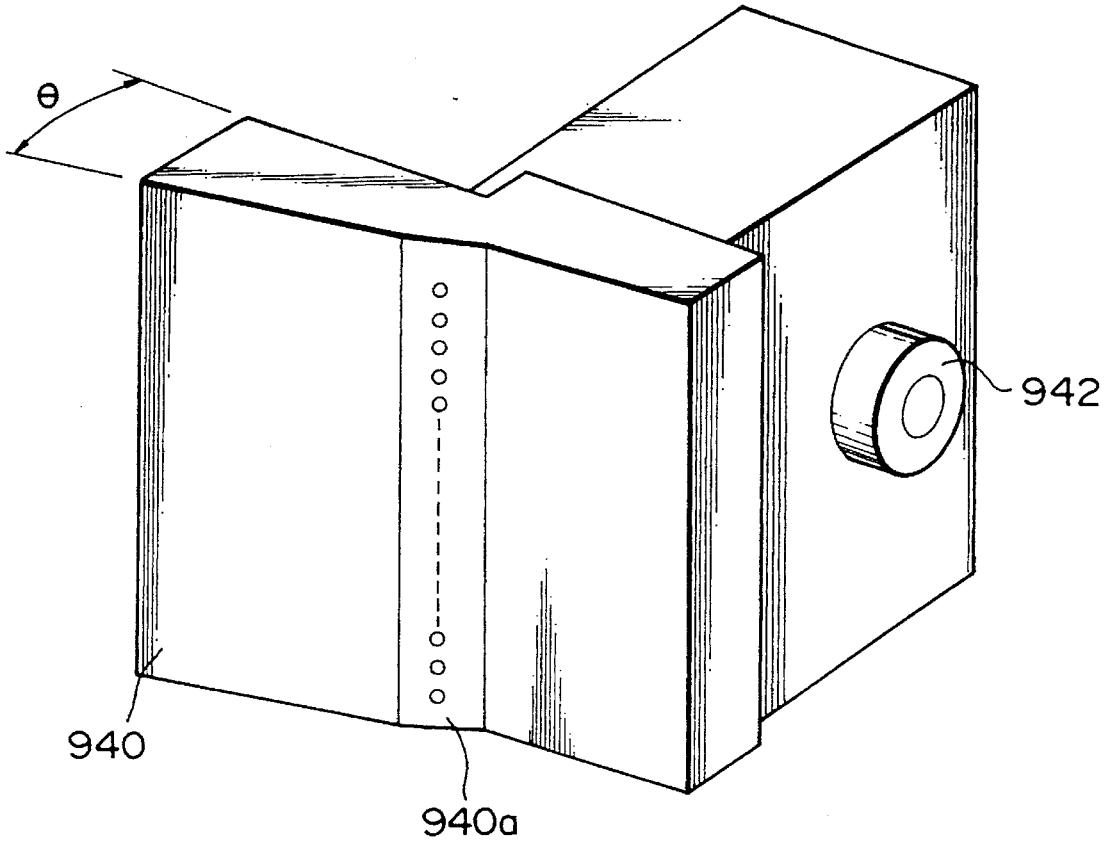
FIG. 8 is a perspective view showing a structural example of the upper plate of the recording head shown in FIG. 7.

As shown in FIG. 8, the orifice forming face and the plane parallel to the recording surface of the recording medium are not parallel to each other but define the designated angle θ, and the orifice forming face has a step **940*a*** at the orifices. This structure, which corresponds to the structure having the designated angle between the fluid route in the orifice plate part and the fluid route behind it, is used in order to form orifices by projecting laser beams from the side of the liquid path formed in the upper plate.

Figure 9:
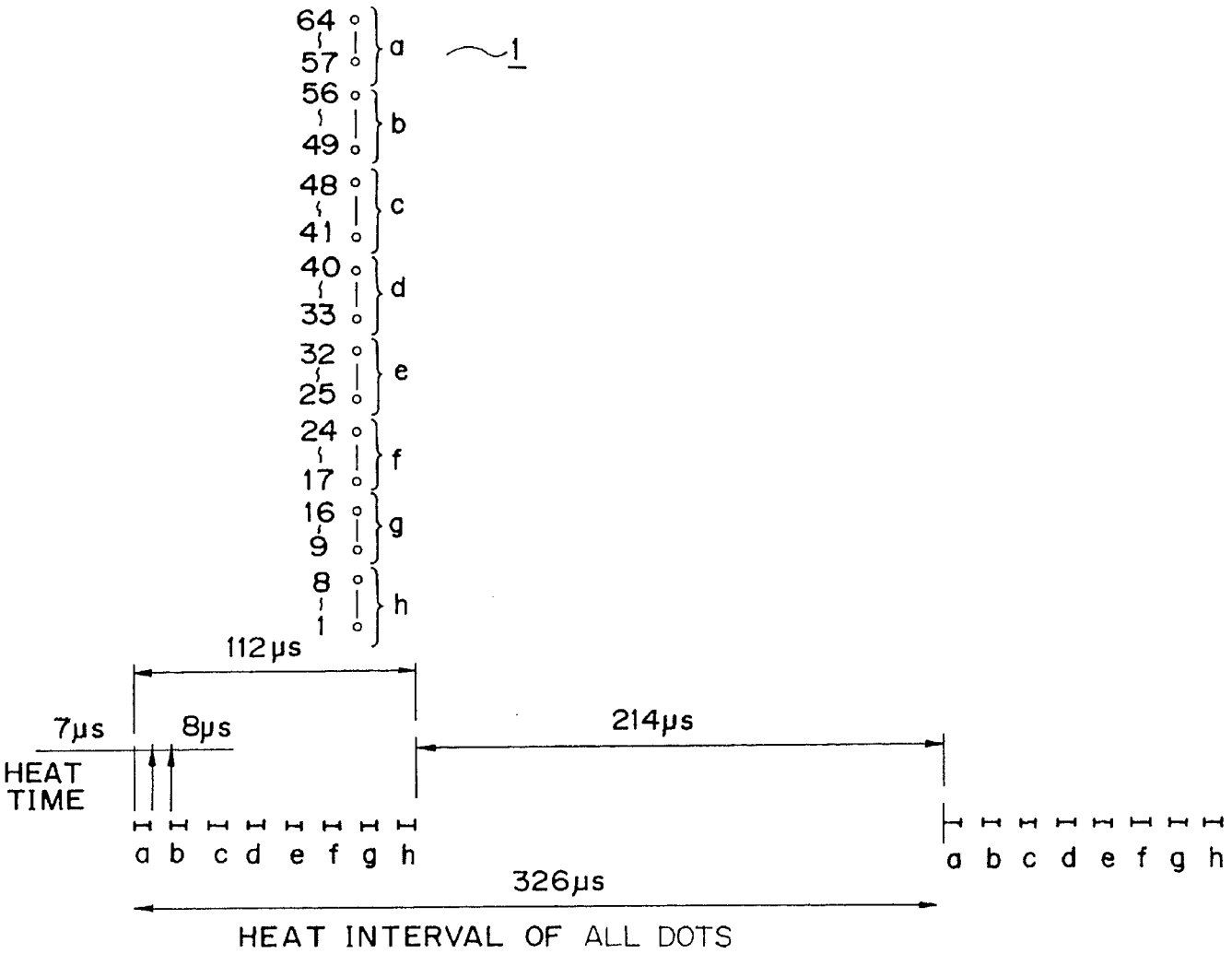
FIG. 9 is a diagram for explaining the timing sequence of heating of the heater of the recording head.

FIG. 9 shows timing sequence for heating of the heater of the recording head. All of 64 heaters are not activated electrically simultaneously. In order to reduce the current used for to drive heaters, all the nozzles (or heaters) are grouped into 8 groups, each group containing 8 nozzles, and 8 nozzles in a group are driven simultaneously. In this embodiment, 64 nozzles are grouped into 8 blocks, a to h, and an electric current is applied sequentially to nozzles from blocks a to h, and nozzles in each group are activated for 7 μsec, and 8 μsec time interval is defined between completing activation of nozzles in one block and starting activation of nozzles in the next block. The recording speed of this apparatus is 64 cps (characters per sec.) and one character is composed of 64×48 dots, thus, the ejection frequency is determined by multiplying 48 (dots) and 64 (cps), that is, 3072 Hz.

Figure 10:
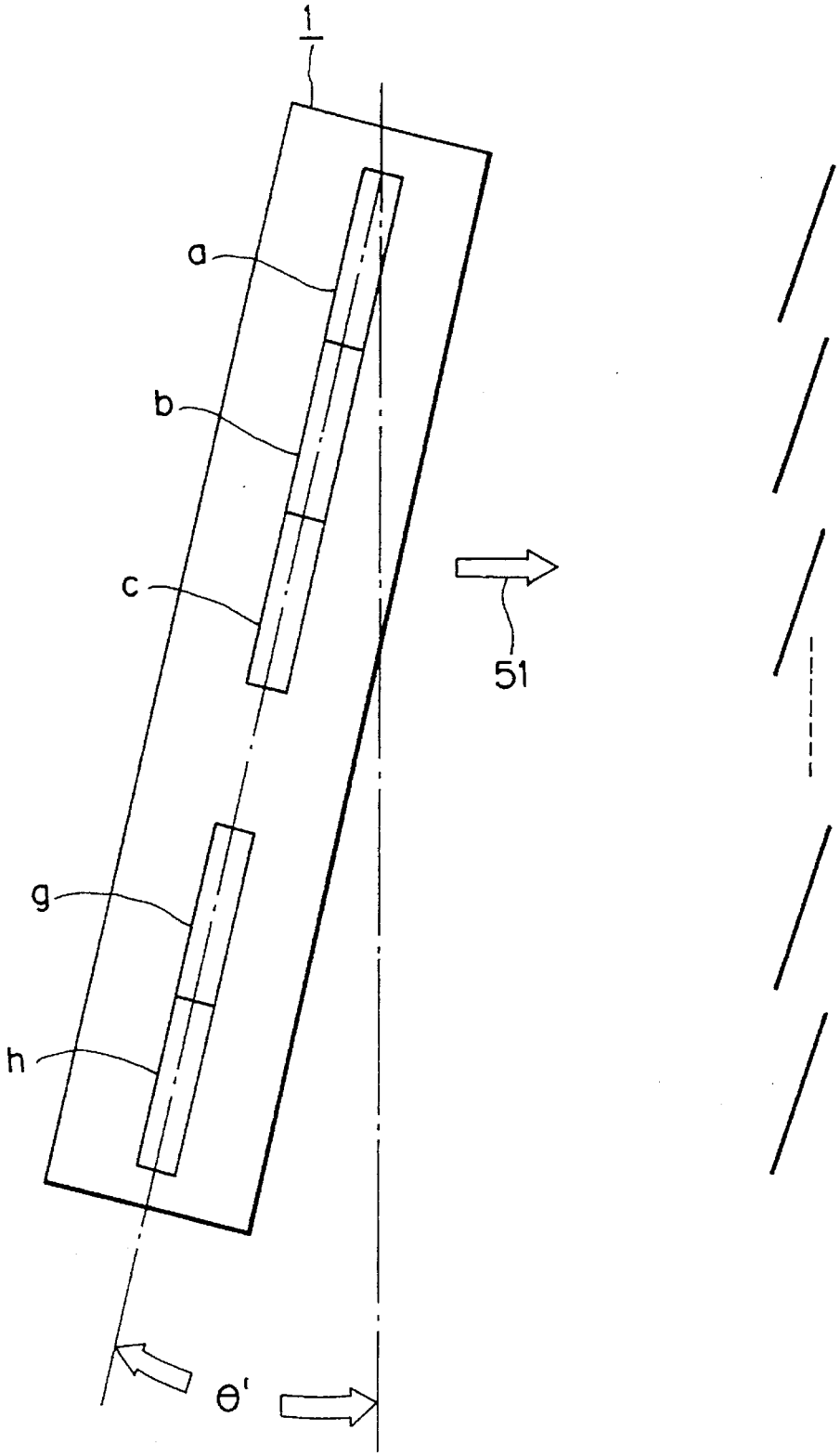
FIG. 10 is schematic view showing the angle of the array of orifices of the recording head with respect to the main-scan direction in the recording operation, and the recorded image.

FIG. 10 shows the angle of the array of orifices of the recording head with respect to the main-scan direction in the recording operation, and the recorded image. The blocks a to h in FIG. 10 correspond to blocks a to h in FIG. 9. The arrow 51 is the main-scan direction, and the time lag between the ejection from orifices of the block a and that of the block h is estimated to be (8 μsec plus 7 μsec) multiplied by 6 blocks plus 8 μsec, that is, 98 μsec. In using the recording head having 64 orifices in this embodiment and the dot pitch is 1/360 inches, the maximum displacement of the recording position is estimated to be 1/360 inches times 98 μsec, that is, 21.2 μm.

The displacement of the recording position due to the ejection timing change can be evaluated by the dot pitch and the timing of heating of the heater. In the above mentioned configuration of the recording head, the displacement of the recording position can be corrected by arranging the mount face of the recording head on the carriage 11 or the orifice forming face itself so as to define the angle θ' between the line along which the orifices are arranged in one dimensional array and the line vertical to the main-scan direction so that the 64th nozzle at the top end of the orifice array and the first nozzle at the bottom end of the orifice array are displaced by 21.2 μm in the main-scan direction.

Now referring to FIGS. 11, 12, 13, 14 and 15, what is explained below is a correction method for the displacement of the recording position caused by the inclination of the recording sheet on its own surface plane by a designated angle in relative to the line defined by the one dimensional array of orifices of the recording head.

<Correction of Displacement of Recording Position>

Figure 2:
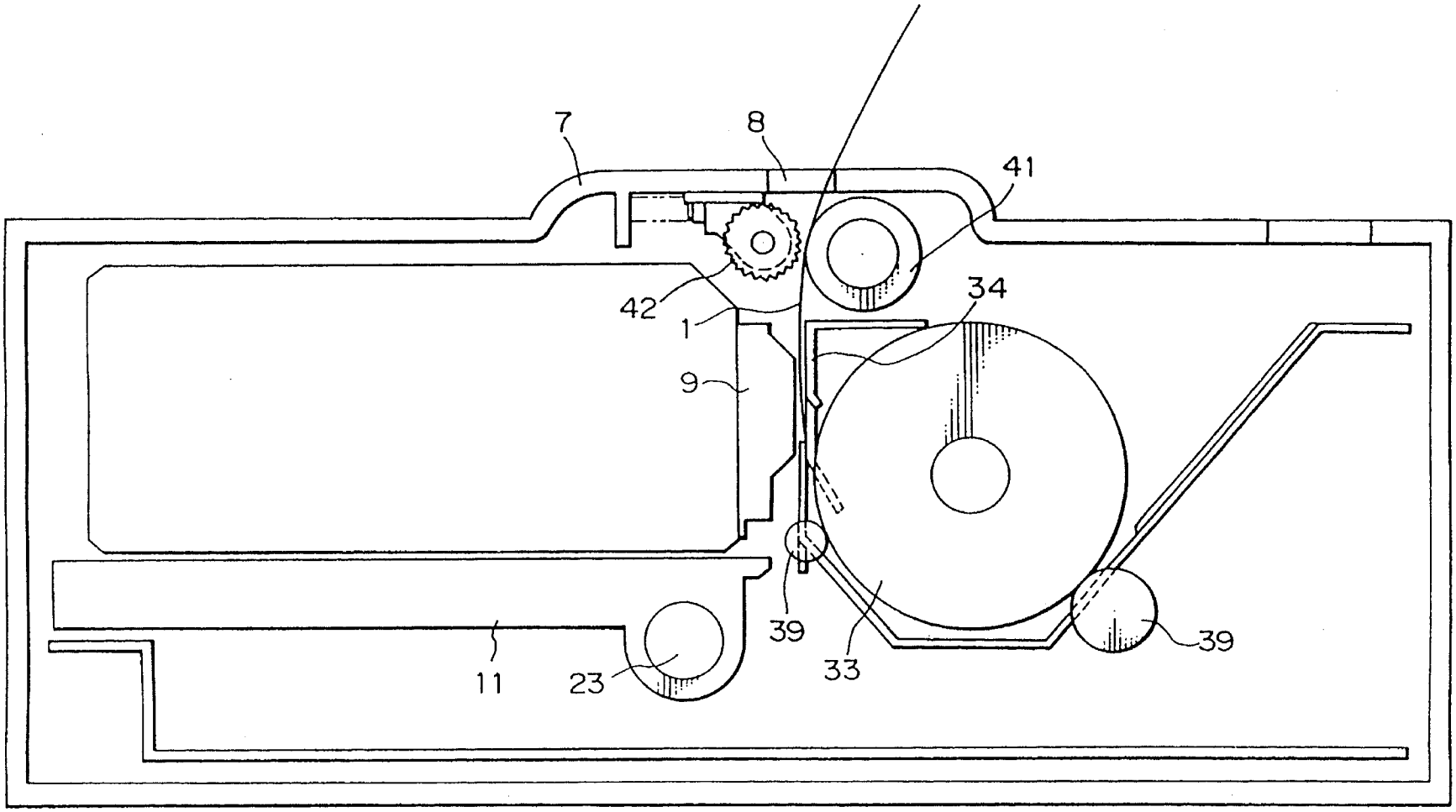
FIG. 2 PRIOR ART
FIG. 2 is a schematic cross sectional view showing a state of the recording medium in the conventional ink jet recording apparatus.
Figure 3:
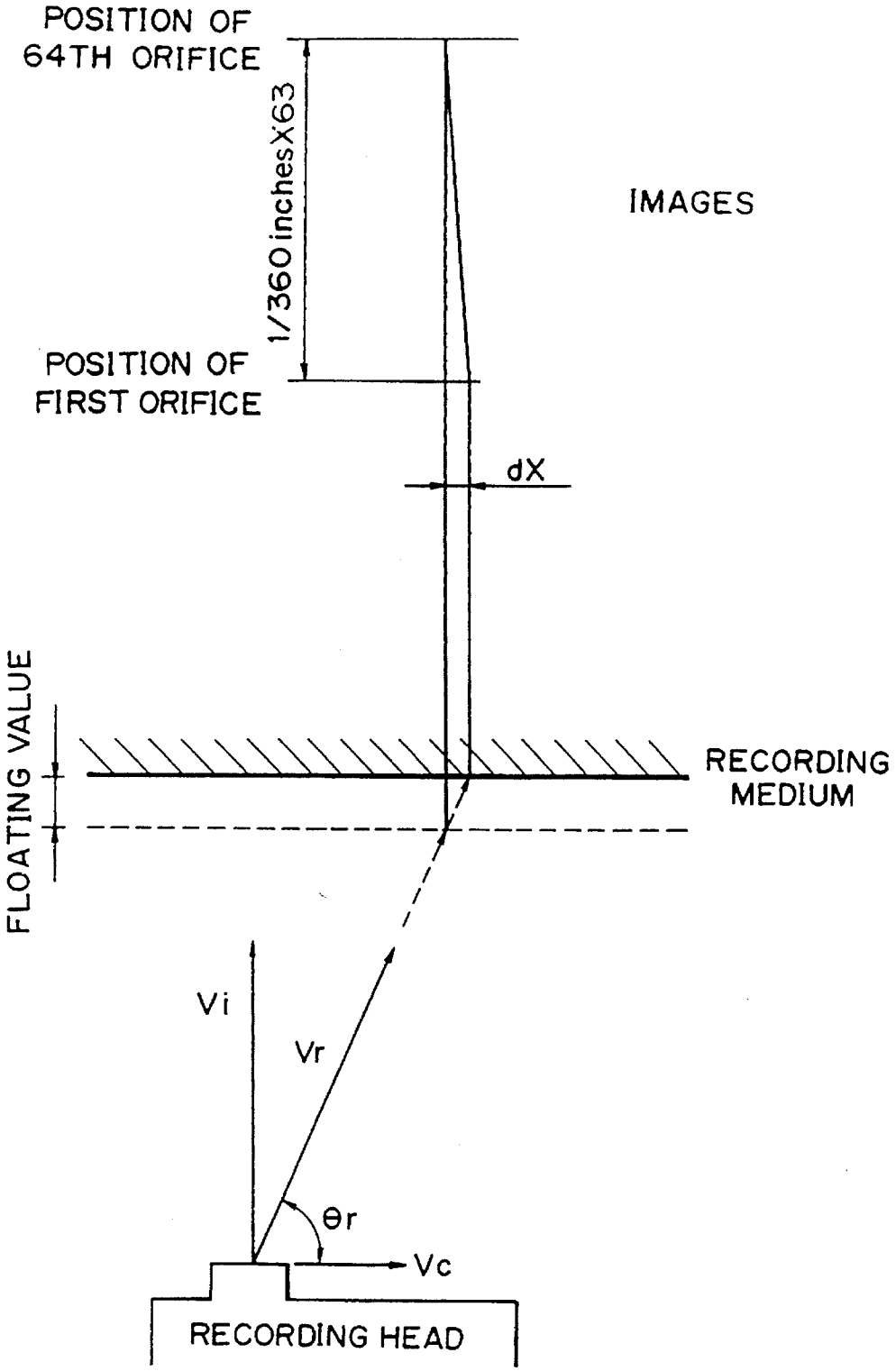
FIG. 3 PRIOR ART
FIG. 3 is a schematic illustration showing the recording position displacement in the conventional ink jet recording apparatus.
Figure 4:
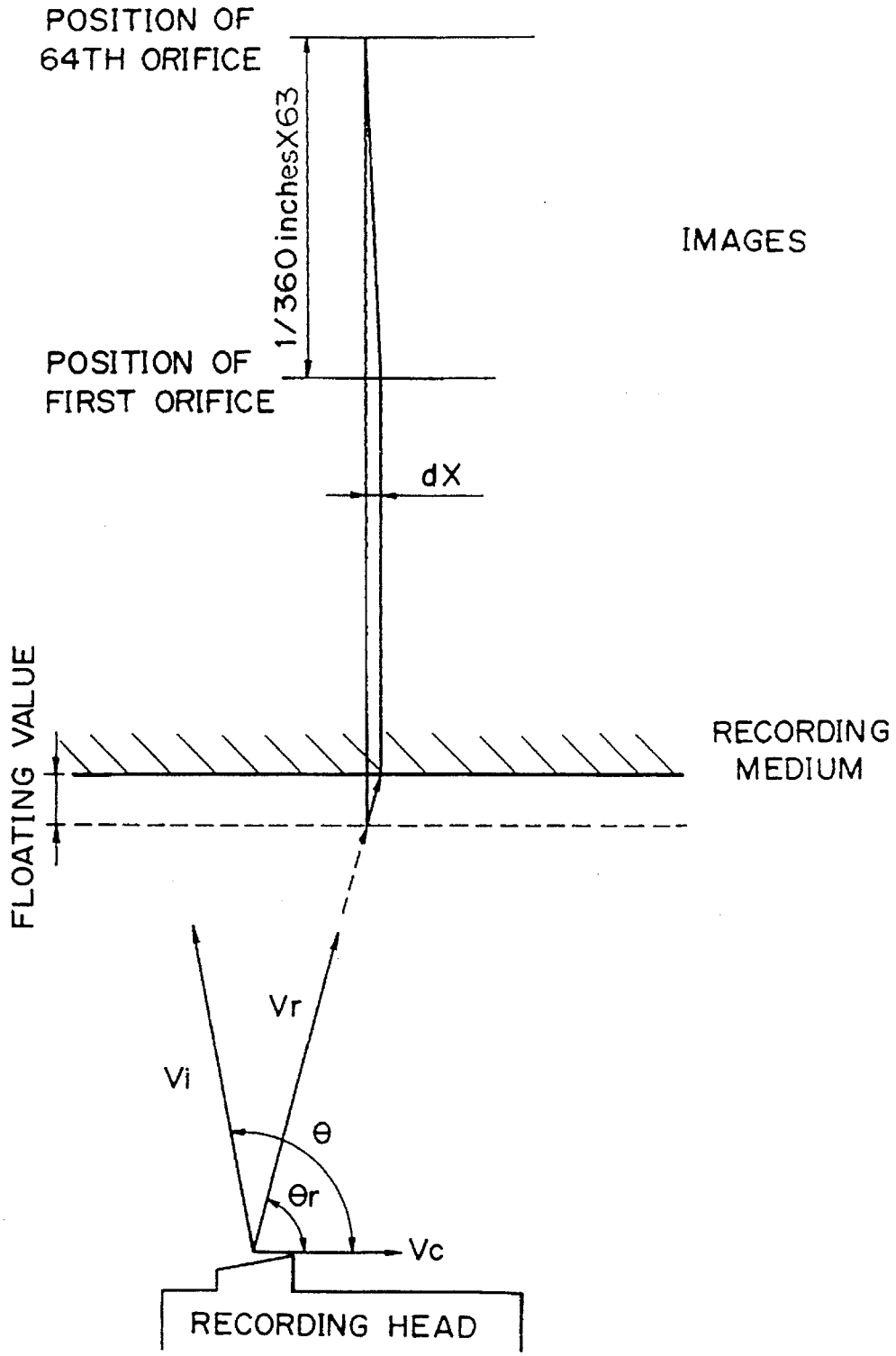
FIG. 4 PRIOR ART
FIG. 4 is a schematic illustration showing the recording position displacement in case that the angle between the orifice forming surface and the surface of the recording medium is defined to be a designated value θ, in the conventional ink jet recording apparatus.
Figure 11:
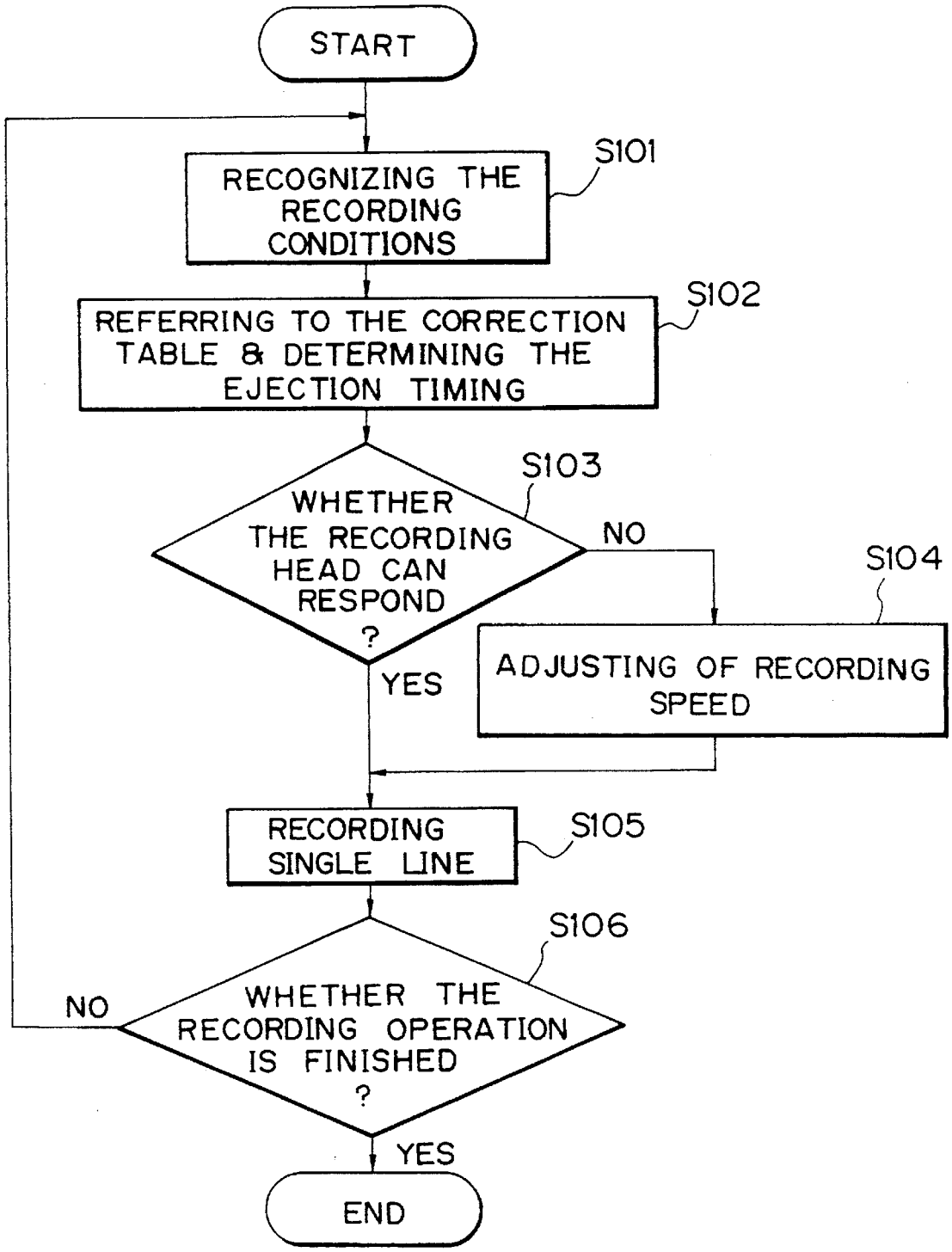
FIG. 11 is a flowchart showing the recording operation of the first embodiment of the present invent ion.
Figure 12:
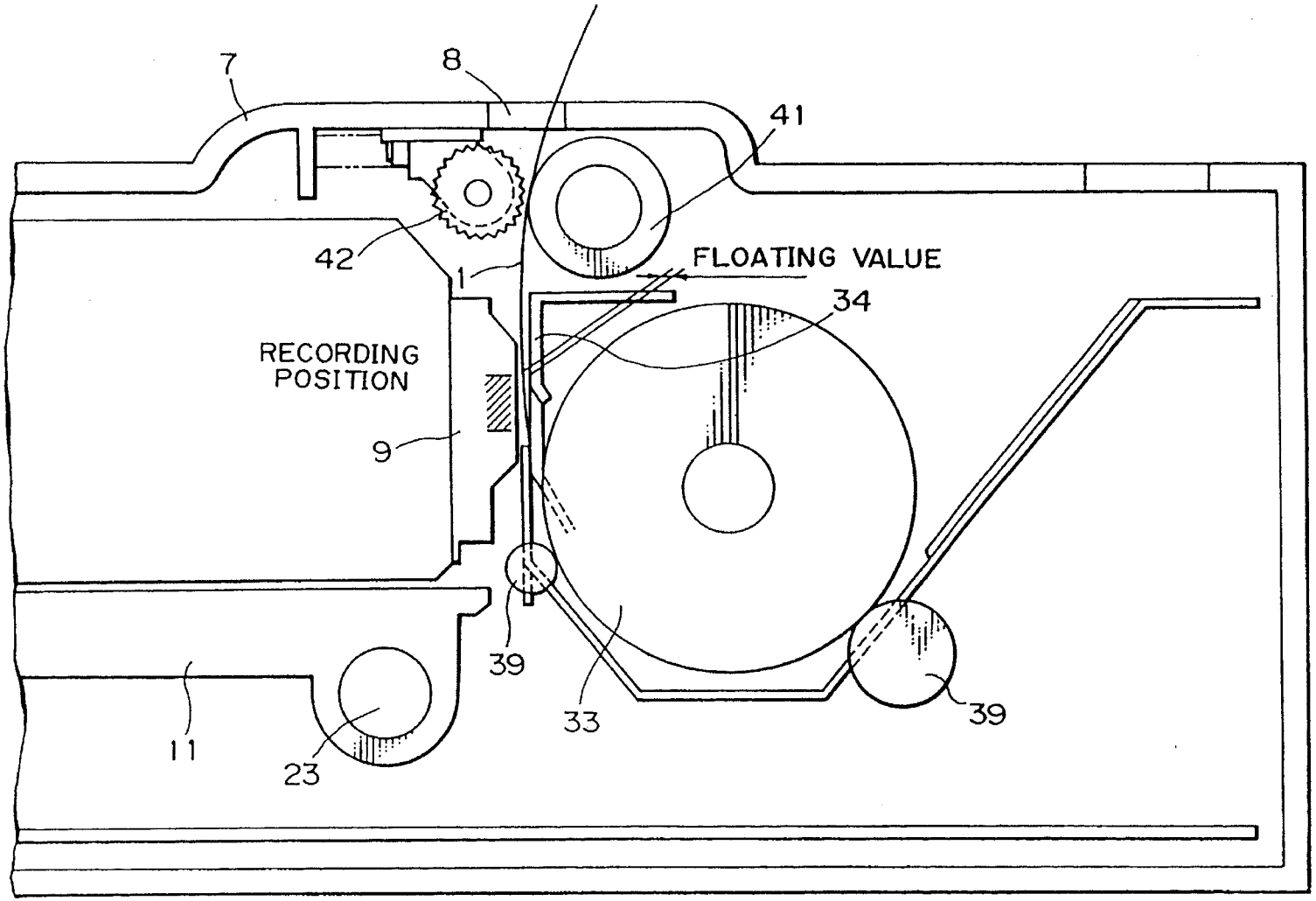
FIG. 12 PRIOR ART
FIG. 12 is a schematic cross sectional view showing a state of the recording medium as a magnified view of a part of FIG. 7.
Figure 13:
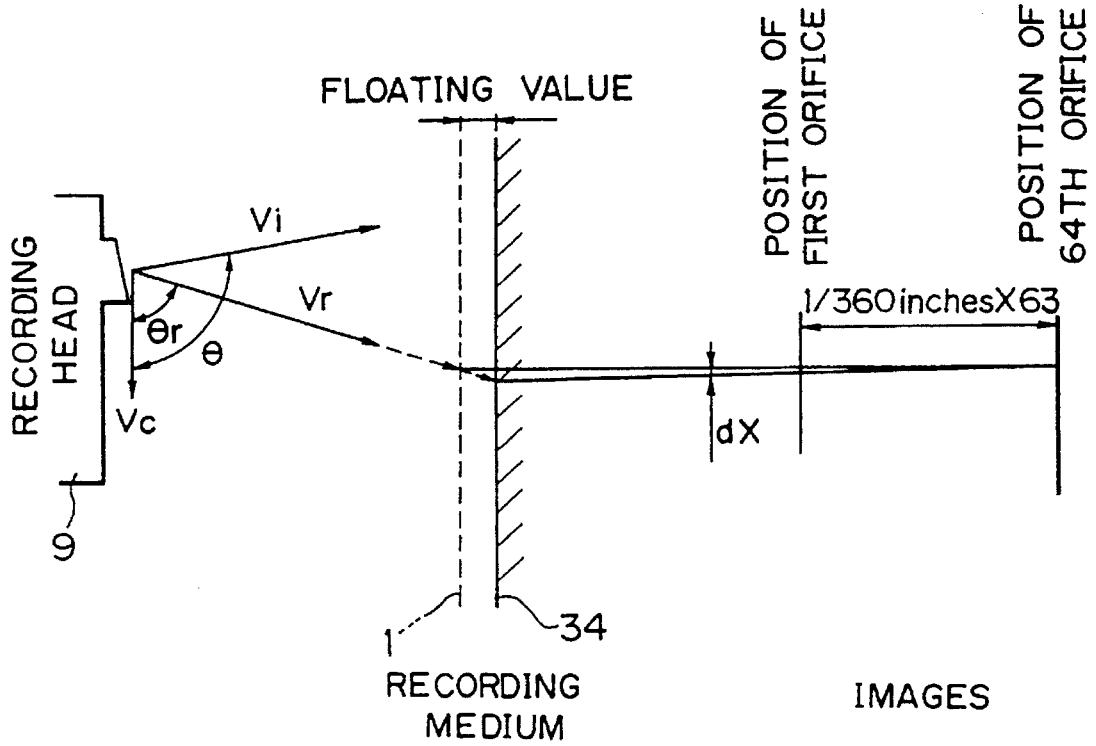
FIG. 13 PRIOR ART
FIG. 13 is a schematic illustration showing the recording position displacement in the ink jet recording apparatus of the present invention.
Figure 15:
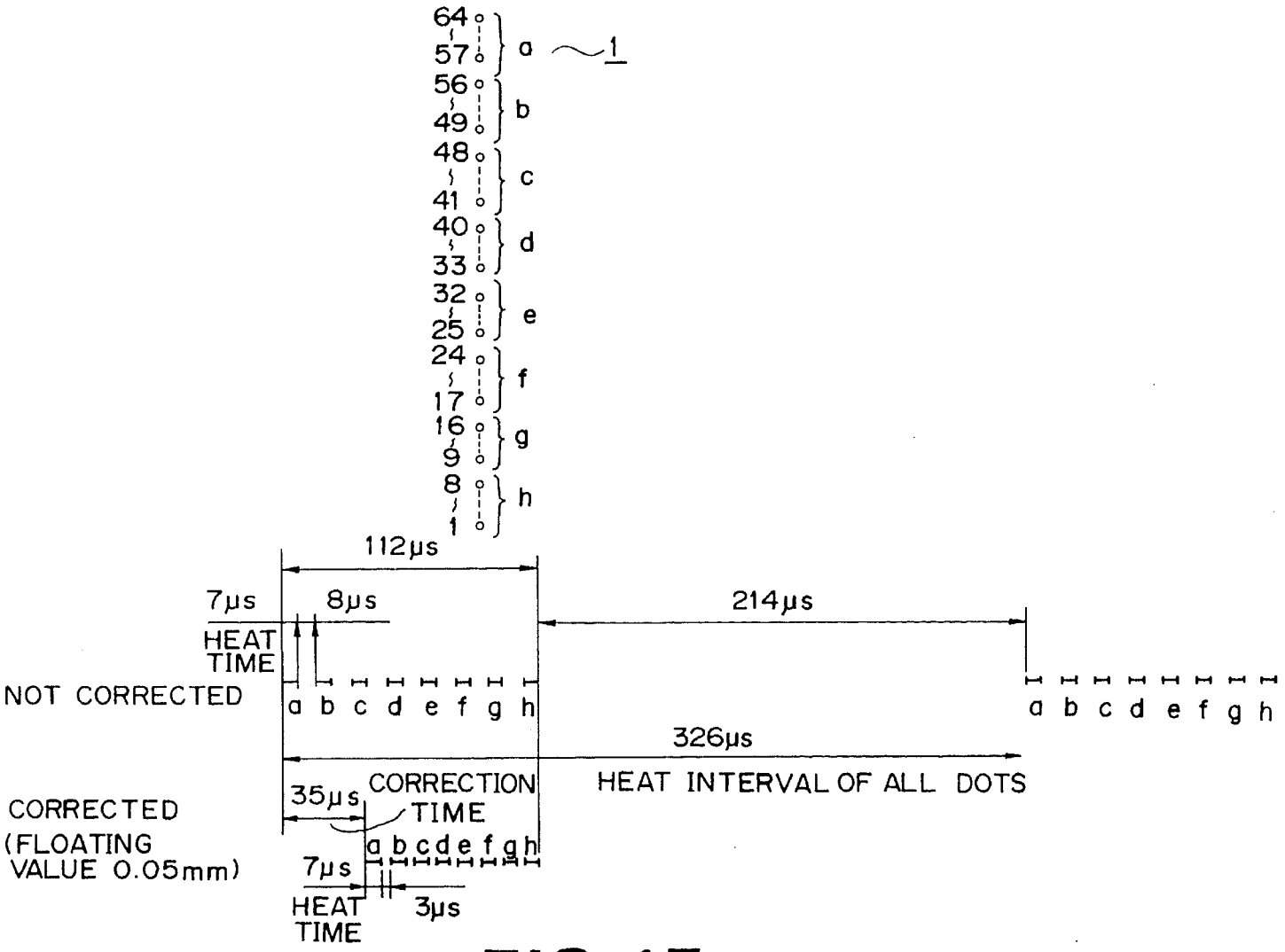
FIG. 15 is a diagram for explaining the timing sequence of heating of the heater of the recording head.

FIG. 11 shows a flowchart of recording procedures in the recording apparatus of this embodiment. The procedures defined in the flowchart can be realized by executing the program stored in the ROM 1702 with the MPU 1701. FIG. 12 shows a cross sectional view of the recording apparatus in the prior art shown in FIG. 2; FIG. 13 is for explaining the displacement of the recording position in the recording apparatus shown in FIG. 12; and FIG. 14 shows the correction table for determining the correction time of activating the heater based on the distance between the recording sheet and the platen (the distance is referred as "floating value" hereinafter) at the recording position. In FIG. 15, what is shown is an example of correction of the heat time and its interval for activating heaters.

In the ink jet recording apparatus shown in FIG. 12, as recording operation for the single recording sheet proceeds in a certain way, the recording sheet 1 may more in a separate way apart from the surface of the platen 34 at the recording position by the head 9 as shown in FIG. 13, and the displacement dx, may vary between the recording device at the top end of the orifice array of the recording head and the recording device at the bottom end of the orifice array of the recording head in accordance with the distance between the surface of the platen 34 and the recording sheet. In order to correct this displacement, the displacement dx is estimated by translating the scanning speed of the recording head 9 into the equivalent time, and the recording timing at the recording device at the top end of the orifice array of the recording head is made to be delayed so as to force the equivalent time estimated as above to be zero. The displacement of the recording position is assumed to be changed linearly from the orifice at the top end to the orifice at the bottom end of the recording head, and thus, the recording timing at the individual recording device can be corrected in the common manner.

In the following, the correction method for the displacement of the recording position is explained in detail.

In FIG. 11, at first in step S101 after starting the print operation in accordance with the print request, what is done is recognition of environmental conditions detected by thermal and humidity sensors and recording conditions defined by user requests. The conditions recognized in this step may contain the size of the recording sheet. The information on the size of the recording sheet may be sent from the host machine connected to the recording apparatus together with the recording data, or may be recognized by detecting the signals from position sensors mounted on the paper tray installed in the recording apparatus. In the next step S102, the correction value is determined with the correction table shown in FIG. 14 and the recording conditions recognized in step S101; data of the correction table are stored in the ROM 1702 and so on.

The correction table is made by actual measurement of the floating value at the recording area shown as a hatched area in FIG. 12, and in the correction table of this embodiment, two parameters are used for correction; one related to the size of the recording sheet, and the other related to the recording position measured in terms of the distance from the top edge of the recording sheet. The recording position can be recognized in terms of the length of feeding the recording sheet in the sub-scan direction and the distance from the home position of the recording head. The home position is not explicitly shown in the figures but specified by the home position sensor installed in the recording apparatus.

Though, in FIG. 14, the floating value at the block "a" of the recording sheet as well as the correction value are defined in the correction table, what is necessary is only the correction value, data stored in the ROM 1720 may not include the distance between the recording sheet and the surface of the platen. In the correction table shown in FIG. 14, the value written before the symbol "/" represents floating value, and the value written after the symbol "/" represents the correction time with which the scanning operation of the recording head should be controlled. The correction time in the correction table is defined in the following manner.

As an example of the correction table shown in FIG. 14, assuming that the environment temperature is estimated to be 15° C. to 25° C., and that the recording sheet is a normal paper sheet used for photo copy for sheet A, the floating value is 0.05 mm at 100 mm to 210 mm measured from the top edge of the recording sheet sized B4. This value is given by the actual measurement. The displacement of the recording position between the orifice at the top end of the orifice array and that at the bottom end of the orifice array in the prior art is about 7.7 μm in correspondence with the above mentioned floating value. This displacement, 7.72 μm, can be interpreted as the scan time t as in $$t=7.72\ \mu m \div Vc\ (\mu m/\mu sec) \text{ or approximately } 35\ (\mu sec).$$

This means that the ink ejection timing should be delayed by 35 μsec at the orifices in the block "a" in order to correct the above described displacement of the recording position. The time t is the correction value itself for the specified floating value. In FIG. 15, what is shown is an example of driving the heater by applying the correction time referred from the correction table. It is assumed that the floating value gradually and linearly decreases from the block "a" to the block "h". Thus, the ejection timing for the heaters in the block "h" is not required to be delayed, and the ejection timing for the heaters in the block "a" is required to be delayed by 35 μsec, and the time difference of ejection timing between adjacent blocks is required to be 3 μsec. In this manner for determining the ejection timing, desirable recording images can be obtained.

In case that the recording head can not respond to the drive signals arriving in so short interval for blocks, which is judged in the step S103, the recording speed is adjusted to be slow enough in the step S104. For example, by making the recording speed in terms of main-scan speed by half, the time interval for driving the recording head by block can be doubled.

So far, now that the ejection timing is determined, the main-scan operation by the recording head is performed and thus, the recording operation for the single line can be completed in the step S105. In step 106, what is judged is whether data to be recorded remain, and if so, going back to the step S101, the recording conditions are recognized again, and the correction time is newly estimated. If data to be recorded do not exist, the recording operation is finished.

By recording information in the above described procedures, even in the state that the recording sheet is apart from the surface of the platen, the designated recording image can be developed on the recording medium in accordance with the size of the recording sheet and the current recording position.

Figure 16:
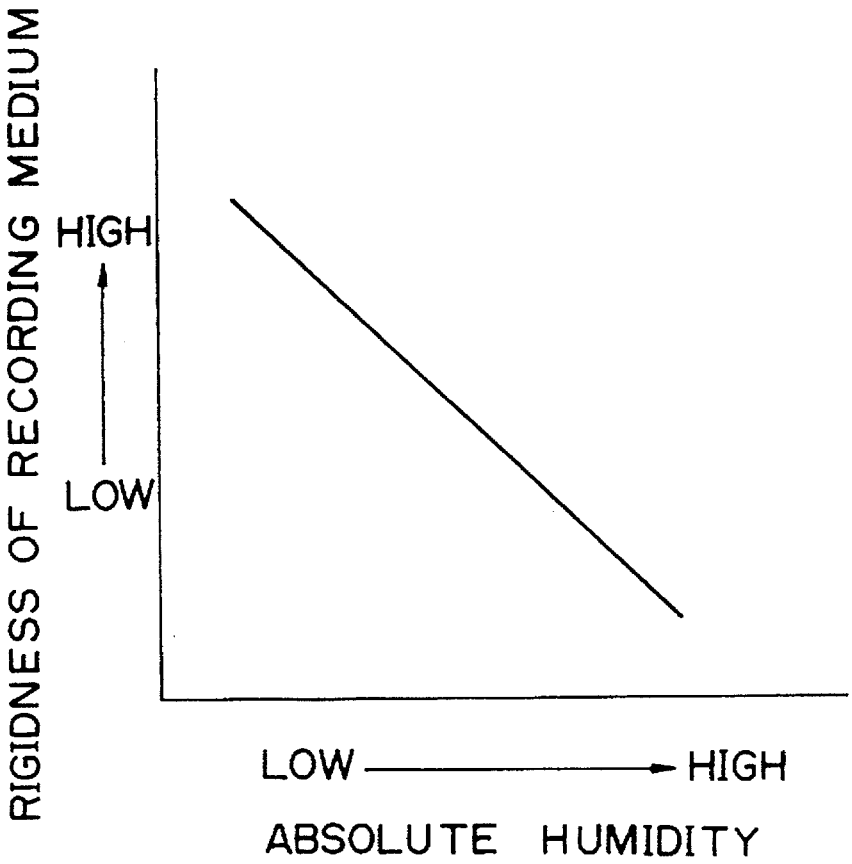
FIG. 16 is a diagram showing a relationship between the rigidness of the recording medium and the absolute humidity.

In the above described example, in order to simplify the explanation, the correction table only includes parameters related to the size of the recording sheet and the recording position. It may be possible to obtain recorded images in higher accuracy by means that the parameter related to the environmental humidity recognized in the step S101 is made to be added and the correction table is configured as a three-dimensional table, or by means that the correction time referred from the correction table is further modified in accordance with the environmental humidity obtained in the step S101. For example, the strength of the recording sheet, or the rigidness of the recording sheet, and the absolute humidity has the correlation shown in FIG. 16. That is, higher the absolute humidity, lower the rigidness of the recording sheet and larger the displacement of the recording position; lower the absolute humidity, lower the displacement the recording position because the recording sheet is more rigid. The displacement of the recording position can be estimated as actually measured values as shown in the correction table in FIG. 14.

The rigidness of the recording sheet is also determined by the quality and thickness of the recording sheet. Therefore, the thickness of the recording sheet or the weight of the unit area of the recording sheet, and the species of the recording sheet, such as high-quality PPC paper and recycled paper, may be captured in the parameter recognized as the recording conditions to be used for determining the correction time, and thus, the correction time can be estimated more precisely. In case of adding these parameters, the displacement of the recording position caused by changes in these parameters must be evaluated by experimental measurement for preparing the correction tables.

As described above, by capturing information on the species the recording medium, the recording position, the environmental temperature and humidity, and the distance between the recording sheet and the recording means, and by adjusting the ejection timing for individual orifices, it will be appreciated that the recording image can be prevented from being slanted caused by the changes in the distance between the recording medium and the recording means at the recording area, and that the recording apparatus realizing high-quality printing can be provided.

The displacement of the recording position caused by the relative position between the recording head and the recording medium may be related not only to the warped shape or slanted positioning of the recording sheet but also to the assembly accuracy of the recording apparatus and the accuracy of components of the recording apparatus. In this embodiment, it will be appreciated that the displacement of the recording position caused by these factors related to assembly components as well as the relative position between the recording head and the recording sheet.

In this embodiment, what is described is the recording apparatus using ink jet method in which ink are ejected by superheating the ink. It is allowed to apply the present invention to the recording apparatus using air jet method in which ink are ejected by using air flow.

[Embodiment 2]

Figure 17:
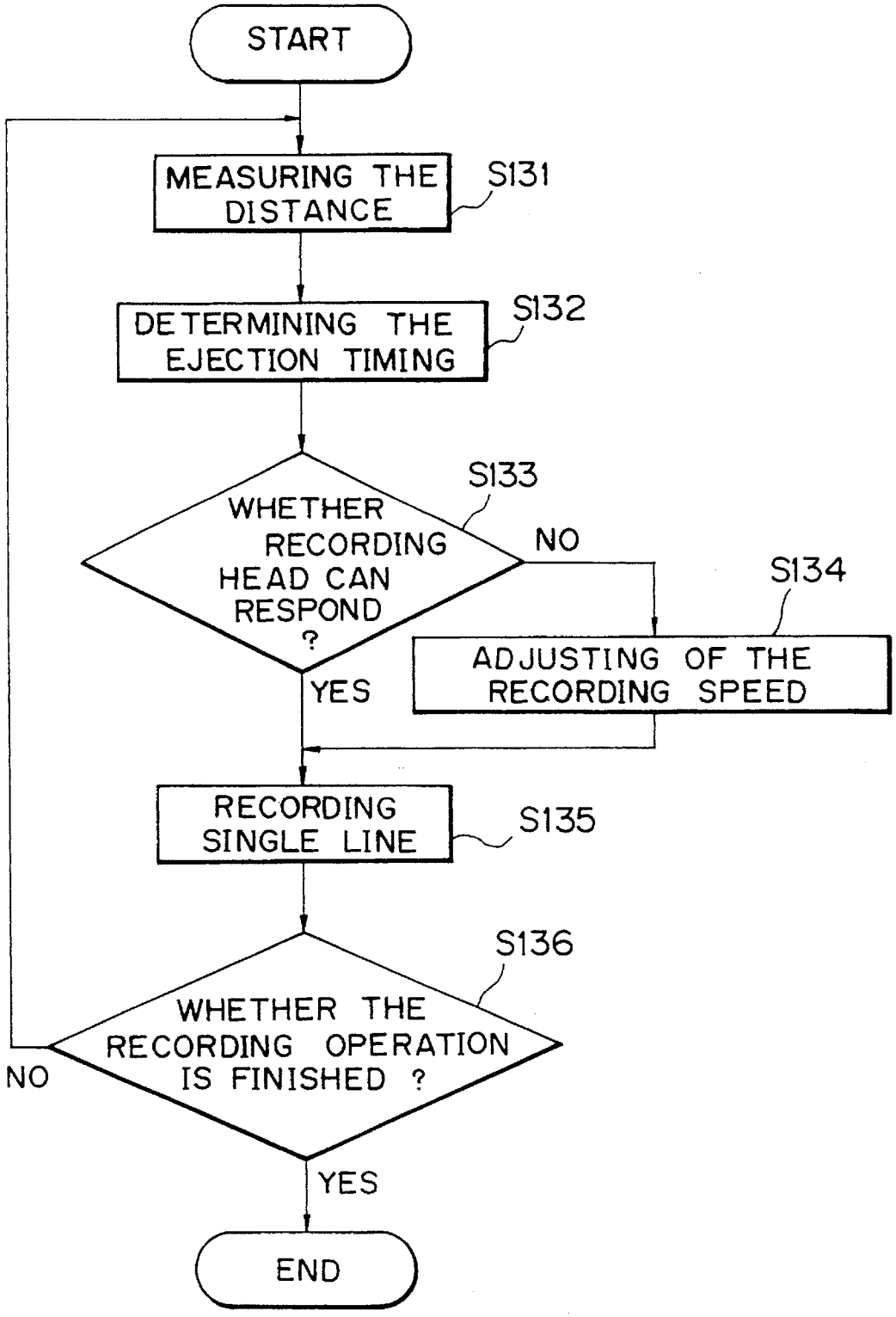
FIG. 17 is a flowchart showing the recording operation of the second embodiment of the present invention.
Figure 18:
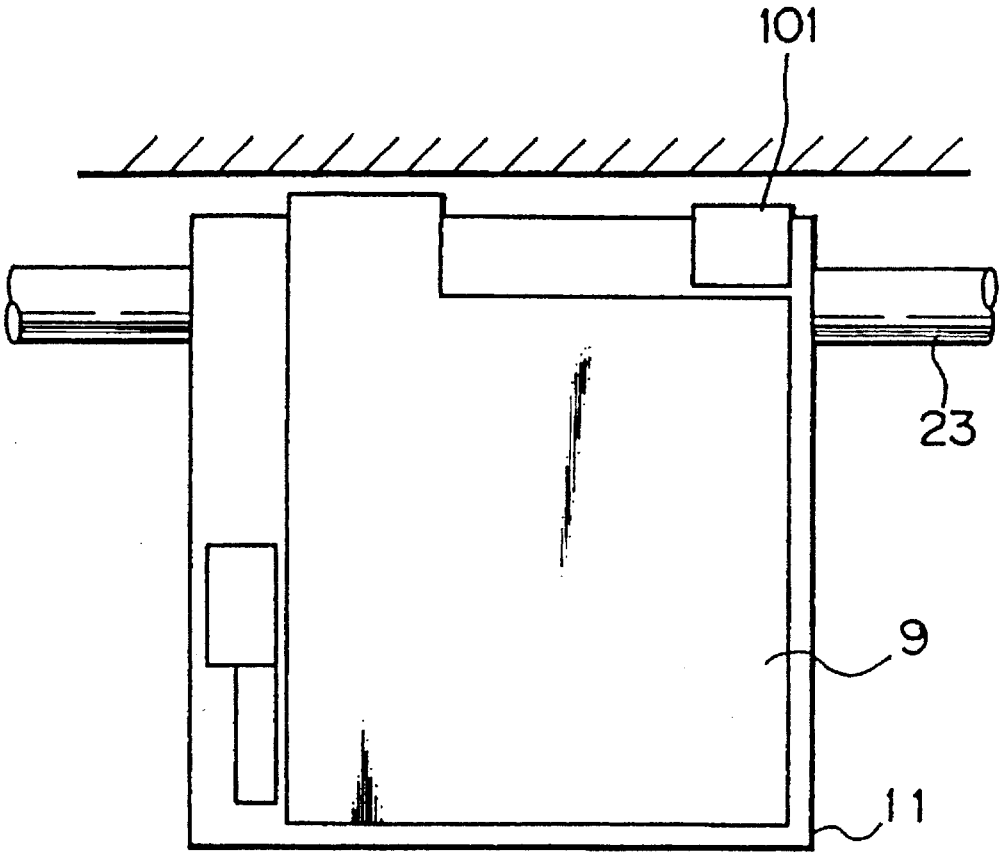
FIG. 18 is a plan view of the recording head cartridge of the second embodiment of the present invention.

Referring to FIGS. 17 and 18, the second embodiment of the present invention is described.

In this embodiment, by means that a sensor 101 such as laser sensor shown in FIG. 18 measures the distance between the orifice at the top end of the orifice array of the recording head, that is, the first orifice, and the surface of the recording sheet and the distance between the orifice at the bottom end of the orifice array of the recording head, that is the 64th orifice, and the surface of the recording sheet, and that the ejection timing from individual orifices is adjusted in accordance with the measured distances described above, and thus by recording information according to procedures in the flowchart shown in FIG. 17, the similar effect to that given by the embodiment 1 can be obtained and the ejection timing can be controlled more precisely in accordance with individual recording conditions than the embodiment 1.

In addition, the distance between the sensor such as laser sensor used for measuring the distance between the surface of the recording medium and the sensor itself is measured, and the ejection timing can be adjusted in accordance with the measured distance.

Now referring to FIG. 18 and the flowchart shown in FIG. 17, the procedure for recording information in this embodiment is described. At first, in the step S131, the sensor 101 mounted on the carriage 11 together with the head cartridge 9 measures the distance between the orifice at the top end of the orifice array of the recording head and the surface of the recording sheet and the distance between the orifice at the bottom end of the orifice array of the recording head and the surface of the recording sheet.

Next in the step S132, the correction value for the ejecting timing is determined based on the difference between the distances measured at the top end and the bottom end of the orifice array in the step S131. In this step S132, the measured distance may be translated into the correction value for time in the similar manner for preparing the correction value to be stored in the correction table in the embodiment 1.

Now that the ejection timing is established so far, next in the step S133, what is judged is whether the recording head can respond to the ejection timing designated by the correction table. If the step S133 judges that the recording head can not accept the drive signal defined in the designated ejection timing, the step S134 is taken next in order to reduce the recording speed lower enough to make the recording head enable to follow the corrected drive signals.

After establishing the ejection timing with which the recording head can record information properly up to the step S133, now next in the step S135, the recording operation for the single line is performed. In case that the step S136 judges that all the data prepared for recording are completed, the overall recording operation is made to be finished.

[Embodiment 3]

The third embodiment of the present invention is described in detail below.

Owing to cost reduction of semiconductor memories and the advance of image processing technologies, image printing including visual photo images can be processed by low-cost recording apparatus.

In case of using such a low-cost recording apparatus, in order to establish high-quality recording images, what is used is a printing method in which a single recording line is recorded with multiple scan operations.

In color printing, individual ink of primary colors, yellow, magenta and cyan, are combined for generating mixed color tones for printing color images.

In general, the recording head used for color printing has an independent recording element for ejecting black ink as well as individual recording elements for three primary colors. This is because it is more advantageous in terms of throughput, running cost and print image quality to separate the recording head for ejecting black ink from other recording heads for three primitive colors than the case of mixing three primary color inks for generating black color.

Figure 19:
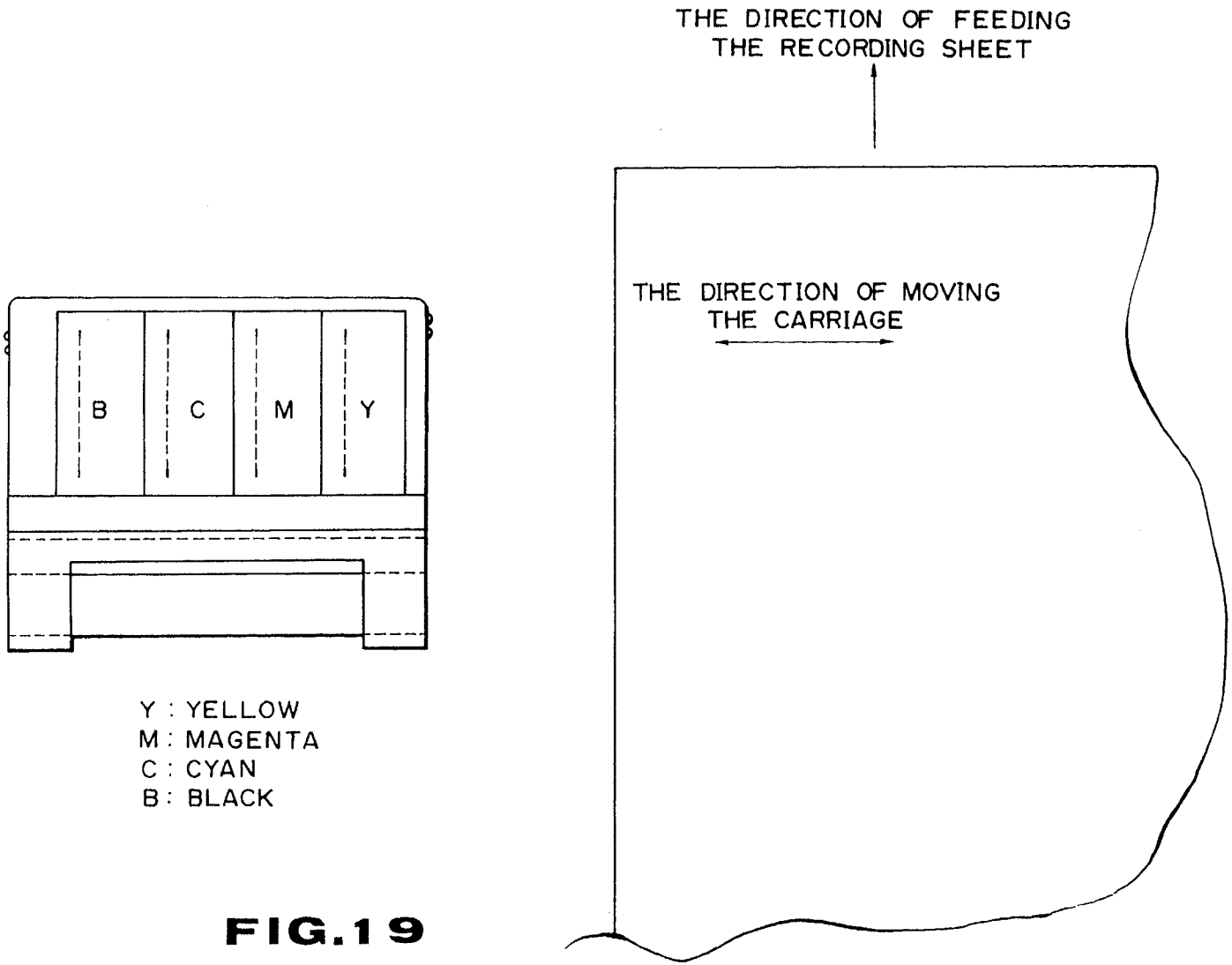
FIG. 19 is a schematic illustration showing an example of the structure for the color recording head.

As for the arrangement of four recording elements, four individual recording elements are arranged in an array geometry in the direction of moving the carriage as shown in FIG. 19, or in an array geometry in the direction of feeding the recording sheet as shown in FIG. 20. As for modification of these cases, the recording heads may be laid out on an arc.

Figure 21:
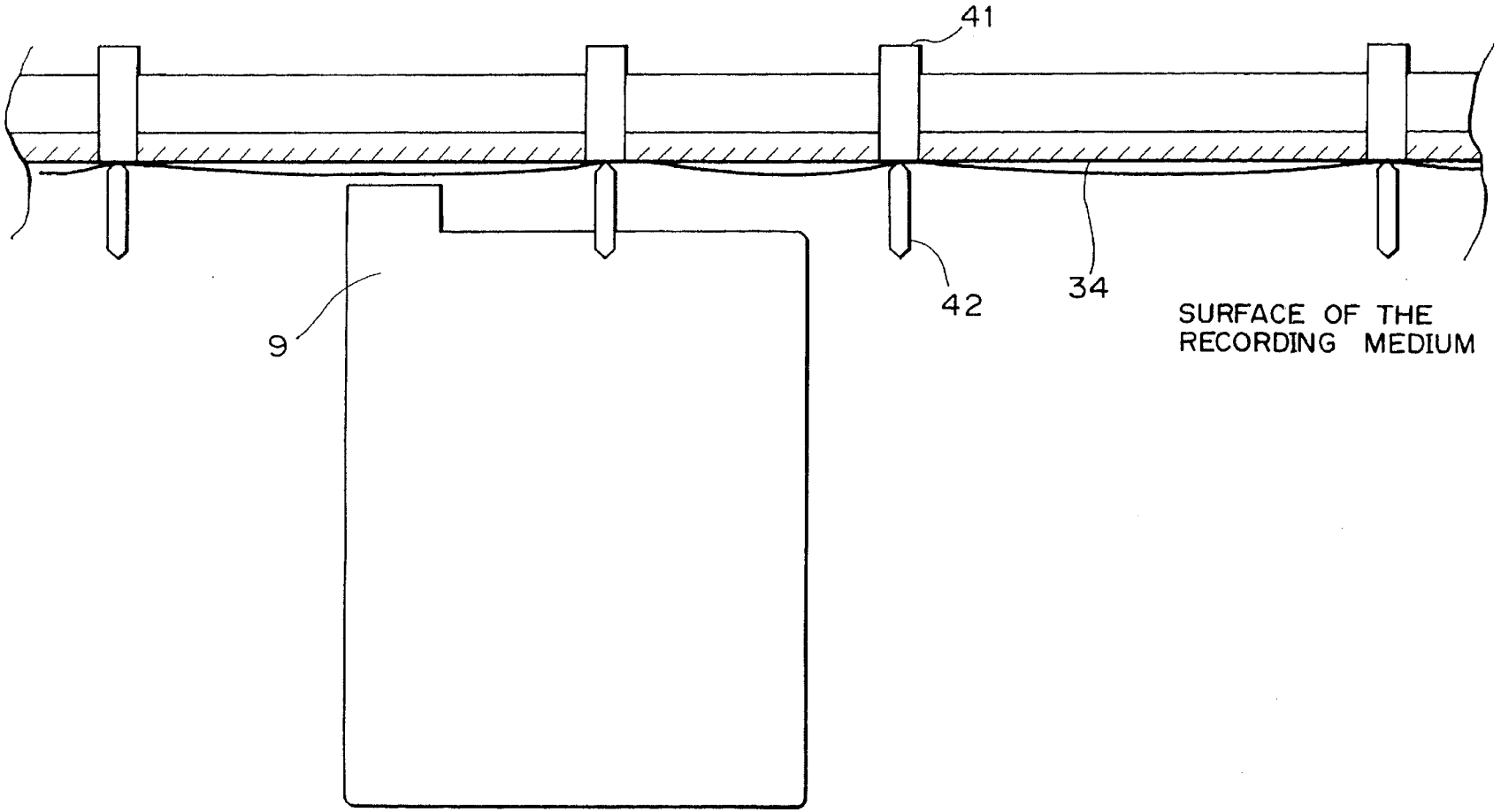
FIG. 21 is a plan view showing the surface of the recording medium related to the third embodiment.

In case of multiple scan printing or color printing the surface of the recording medium is corrugated as shown in FIG. 21 because the area of the recording medium on which ink droplets are projected and absorbed within the recording medium expands and coexists with its neighboring area without absorbing ink.

Figure 22:
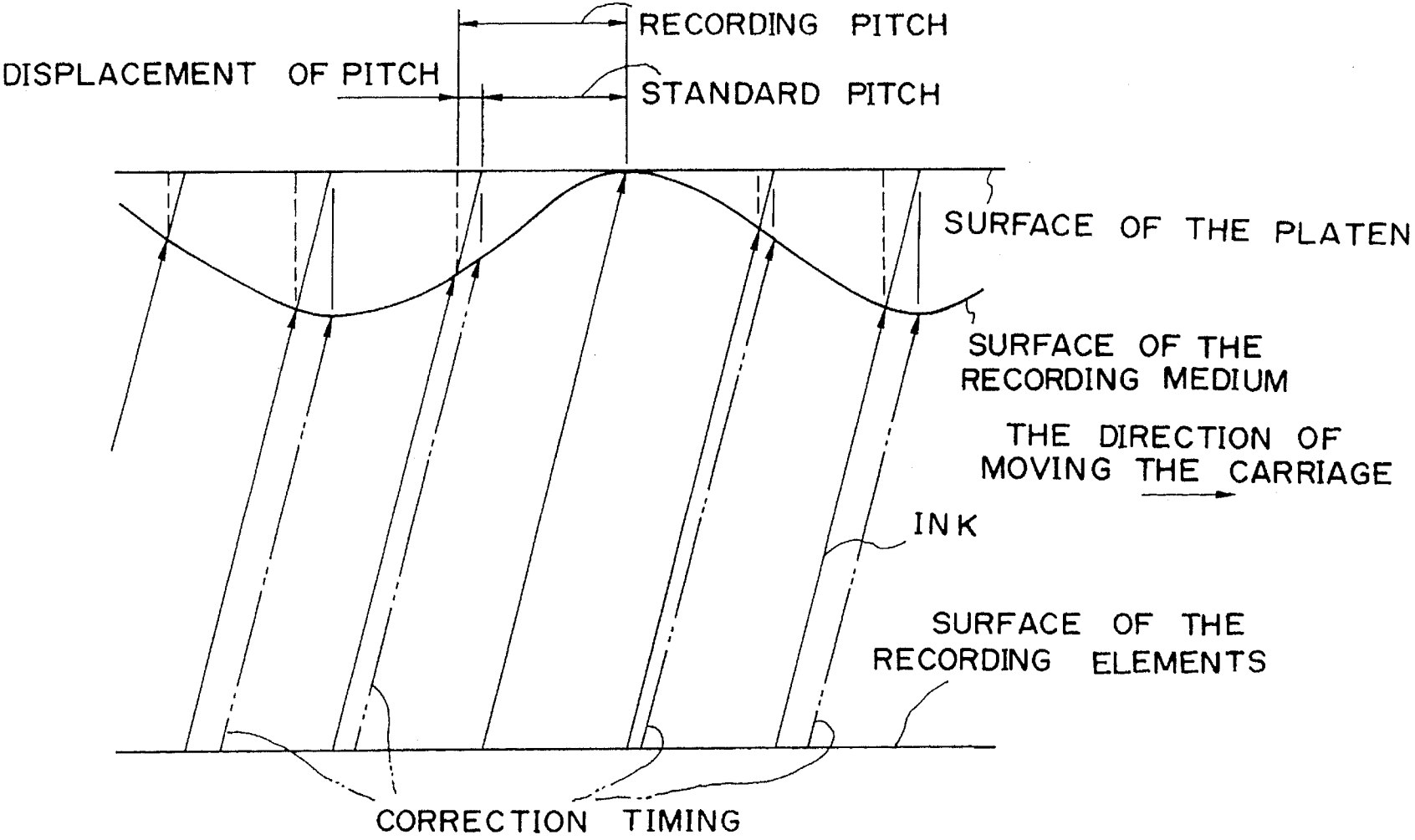
FIG. 22 is a magnified plan view showing the surface of the recording medium related to the third embodiment.

This corrugation of the surface of the recording medium can be controlled to a certain extent by the layout of the spur 42 which contacts to the surface of the recording medium with the minimum contact area or maximum contact angle for preventing the spur from brushing ink projected on the recording medium and by shaping the ribs of the platen 34 so as to capture the corrugated surface of the recording medium. Even by those methods described above, the corrugation of the surface of the recording medium can not be reduced completely, and as shown in FIG. 22, due to the corrugated shape of the surface of the recording medium, the dot pitch in the main-scan direction may not be maintained to be uniform in case of the slanted orifice array as in the embodiment 1, which leads to the degradation of the quality of recording images.

In the above described structure, as the speed of the carriage movement is faster than the speed of expansion of the surface of the recording medium absorbing ink, it seems that the recording operation only in the single line is not affected by the corrugation of the current line of the recording medium. However, in the actual cases, the recording operation is not limited to the single line printing but repeated in a plurality of lines in the recording sheet, and therefore, as the corrugated surface on the printed lines may affect the recording on the later lines, which leads to disturbance in the attempt to make uniform the recording pitch.

Furthermore, in case of multiple scan printing or color printing, the corrugations in not only the previous lines but also the current line may affect the recording on the current line, since there is a lapse of time before second or third scan printing is operated.

In the recording head construction shown in FIG. 20, not only the dot pitch may be subject to the uniformly corrugated surface of the recording medium, but also the complex corrugated surface. The amount of ink projected on the recording medium may change based on the recording order or the order of ejecting individual color ink and the amplitude of the corrugation or a gap between the recording medium and the platen, may change. In addition, the corrugation on the current line may affect the recording not only on the current line but also the latter lines of the recording medium.

Figure 23:
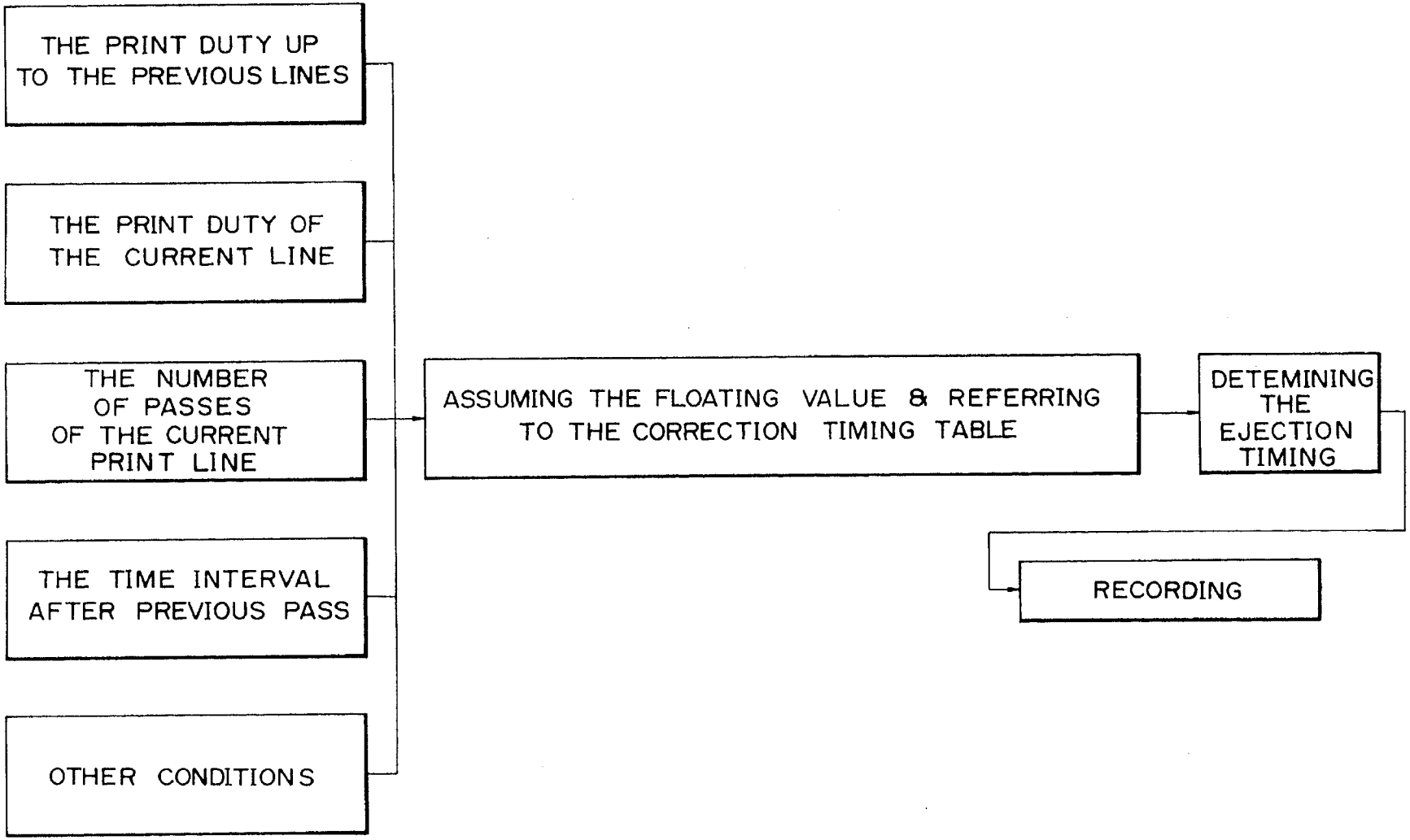
FIG. 23 is a block diagram showing the recording operation of the third embodiment.

As shown in FIG. 23, the ejection timing is modified based on the correction table shown in FIG. 24 in the similar manner to the embodiment 1 by considering the print duty in the previous print lines, the print duty in the current print line, the number of traces (passes) of the current print line with different color ink, and the time interval after completing the recording operation of the current print line with different color ink.

As an example of the correction table shown in FIG. 24, assuming that the print duty up to the previous lines is 30% or less and the print duty of the current line is 30% or less, and the environment temperature is estimated to be 15° C. to 25° C. and the environment humidity is estimated to be 40 to 80%, and that the recording sheet is a normal paper sheet used for photo copy and its size is B4, the distance between the recording sheet and the surface of the platen is 0.05 mm at 10 mm to 15 mm measured from the top edge of the recording sheet sized B4. This value is given by the actual measurement. The displacement of the recording position between the orifice at the top end of the orifice array and that at the bottom end of the orifice array in the prior art is about 7.7 μm in correspondence to the above mentioned floating value. This displacement, 7.72 μm, can be interpreted as the scan time t as in $$t=7.72\ \mu m \div Vc\ (\mu m/\mu sec) \text{ or approximately } 35\ (\mu sec).$$

This means that the ink ejection timing should be delayed by 35 μsec at the orifices in the block "a" in order to correct the above described displacement of the recording position. The time t is the correction value itself for the specified floating value.

By referring to the correction timing table described above, and by recording images by adjusting the ejection timing based on the correction value in the correction table, even in case of printing images with high print duty and printing images including multiple color ink recorded in multiple scanning operations of the recording head, it will be appreciated that the quality of recorded images can be maintained to be high enough.

In the above description, the recording conditions include the environmental parameters, the species of the recording medium and the size of the recording medium and so on, each similar to the conditions mentioned in the embodiment 1.

In case of printing images in dual scan operation of the recording head, as the velocity vector defined by the to-and-fro action of the carriage 11 affects the direction of ejecting ink, it will be appreciated that higher quality can be obtained for the recorded images by correcting the direction of ejecting ink in the similar manner using the correction table.

[Embodiment 4]

The fourth embodiment of the present invention is described in detail below.

As a general purpose recording apparatus, it is important for the recording apparatus of the present invention to enable to accept thick sheets such as OHP films, cards, post cards and envelopes for the recording medium as well as papers used for photocopy.

With respect to coping with various kinds of recording media, the structure for adjusting the distance between the recording head and the recording medium is used in the prior art systems.

Figure 25:
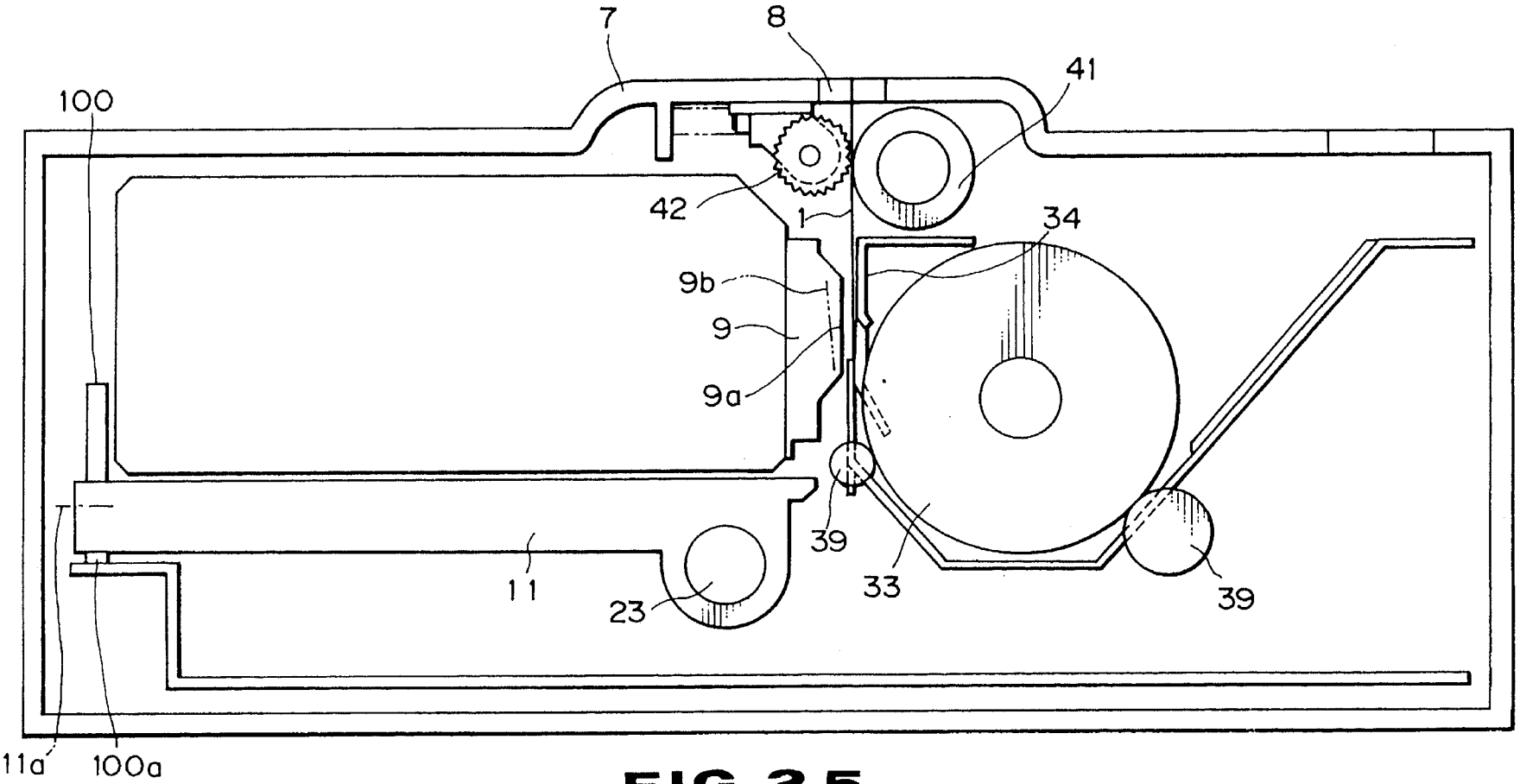
FIG. 25 is a schematic cross sectional view showing the fourth embodiment of the ink jet recording apparatus of the present invention.

Now referring to FIG. 25, the embodiment 4 of the present invention is described in detail.

Figure 1:
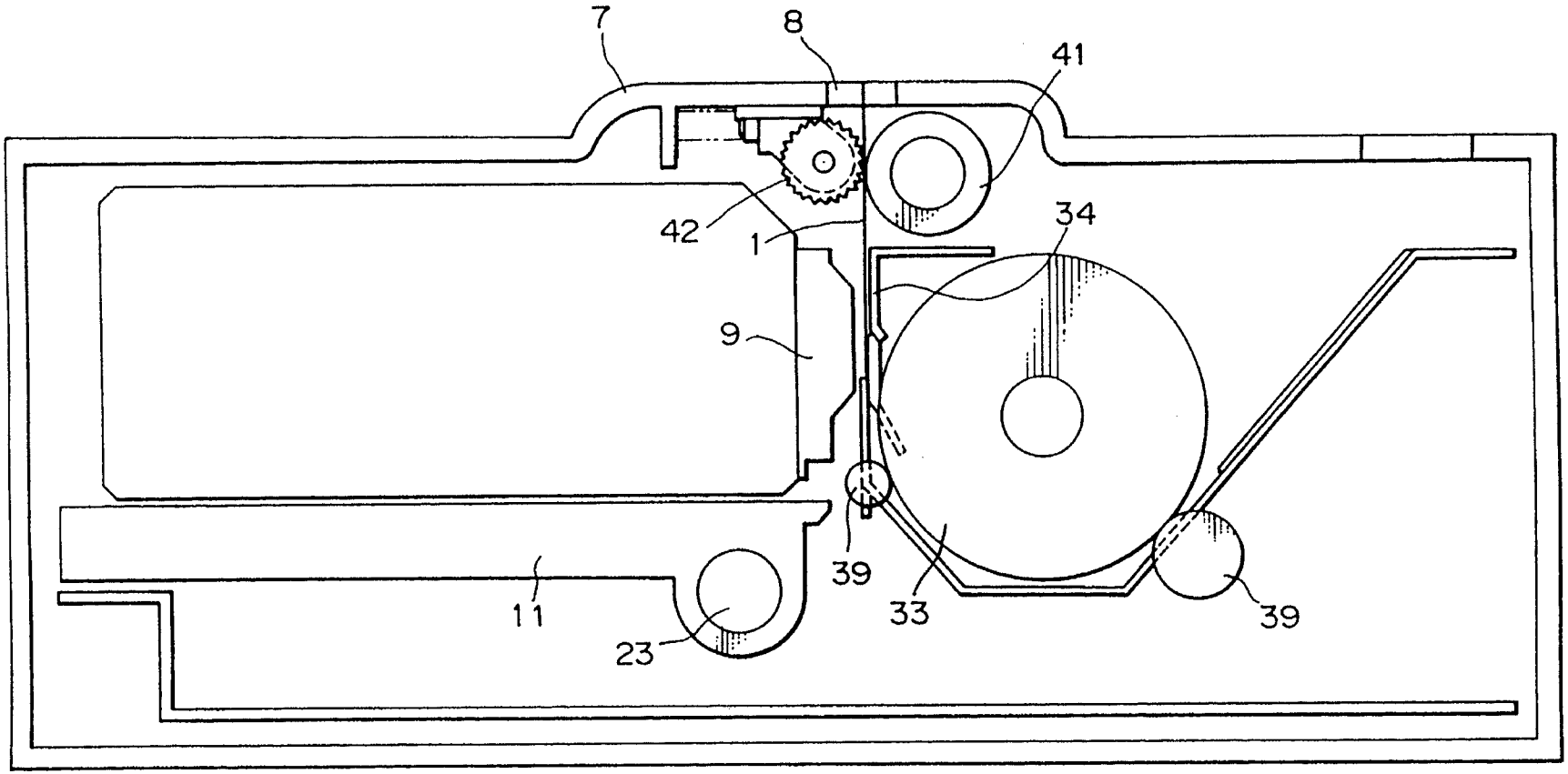
FIG. 1 PRIOR ART
FIG. 1 is a schematic cross sectional view showing a conventional ink jet recording apparatus.

The structure shown in FIG. 25 is almost similar to that shown in FIG. 1 and a distance adjusting lever 100 is installed for accepting the recording medium having larger thickness.

The distance adjusting lever 100 can rotate around the axis 11*a* as the rotating axis of the carriage 11, and when it rotates, the distance between the rotating axis and the surface 100*a* of the cam contacting to the chassis, and the carriage 11 rotates around the carriage axis 23, and the orifice forming face moves between the positions 9*a* and 9*b*.

With this structure of the recording apparatus, in case of recording images on a thin recording sheet such as photocopy paper, the recording operation is performed with the orifice forming face being positioned at 9*a*, and in case of accepting a thick recording sheet, the recording operation is performed with the orifice forming face being moved and positioned at 9*b* by the distance adjusting lever 100, and so far it is possible to establish a proper distance between the recording medium and the recording head.

However, in the structure of the recording apparatus of this embodiment, as the orifice forming face 9*b* is not parallel but slanted to the surface of the recording sheet, the distance between individual orifices and the recording medium is not uniform, and hence, the displacement of the recording position as mentioned in the embodiment 1 occurs.

In adjusting the distance with the distance adjusting lever, by detecting the adjusting operation with position switches, and by referring to the correction table for modifying the ejection timing defined in the similar manner to the embodiment 1, it will be appreciated that the quality of recorded image may be maintained to be high enough as similar to the embodiment 1, even if using thick recording medium.

[Embodiment 5]

As described above, in addition to such a factor for reducing the quality of recording images as changes in the distance between the recording device and the recording medium, there are further such problems related to the reduction of the quality of recording images as a problem in reducing the displacement between the previous lines and the current line, which is commonly concerned to every recording apparatus, and problems concerned specifically to the ink jet recording apparatus; the diameter of dots developed on the recording medium changes in accordance with the species of the recording medium, the characteristic of individual recording heads, the operational environment, the history of recording operations and the quantity of ink remained in the ink tank; and ink may not be ejected accidentally from orifices because paper powder sludge is piled up on the orifices.

Figure 26:
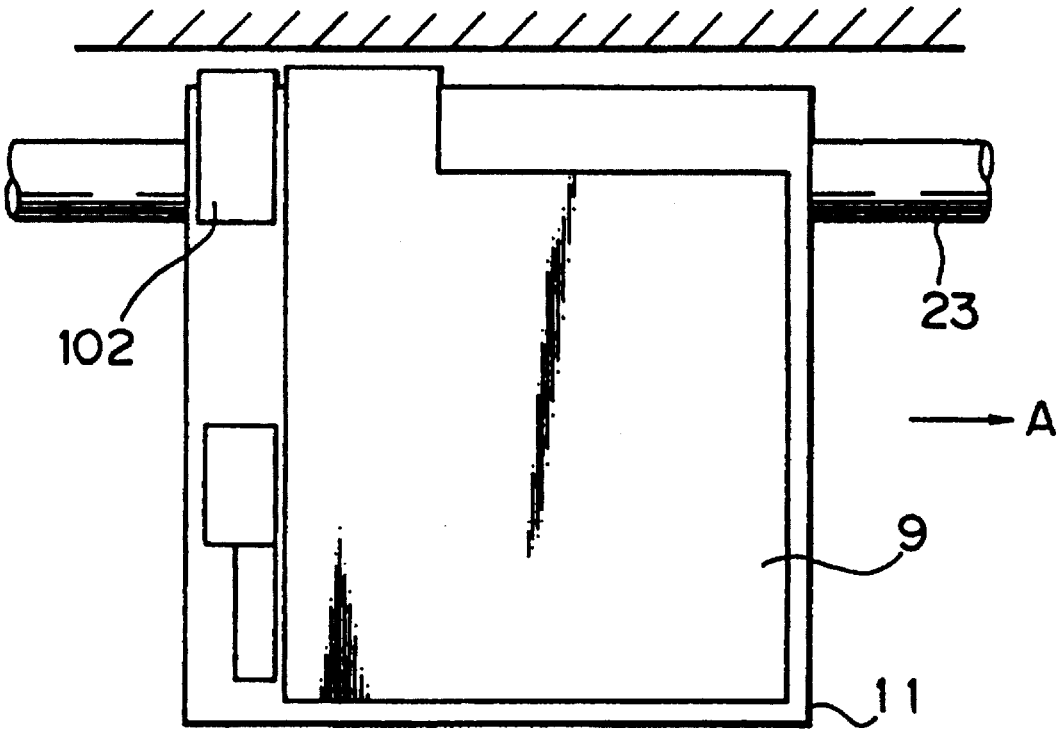
FIG. 26 is a plan view showing the fourth embodiment of the recording head cartridge of the present invention.
Figure 27:
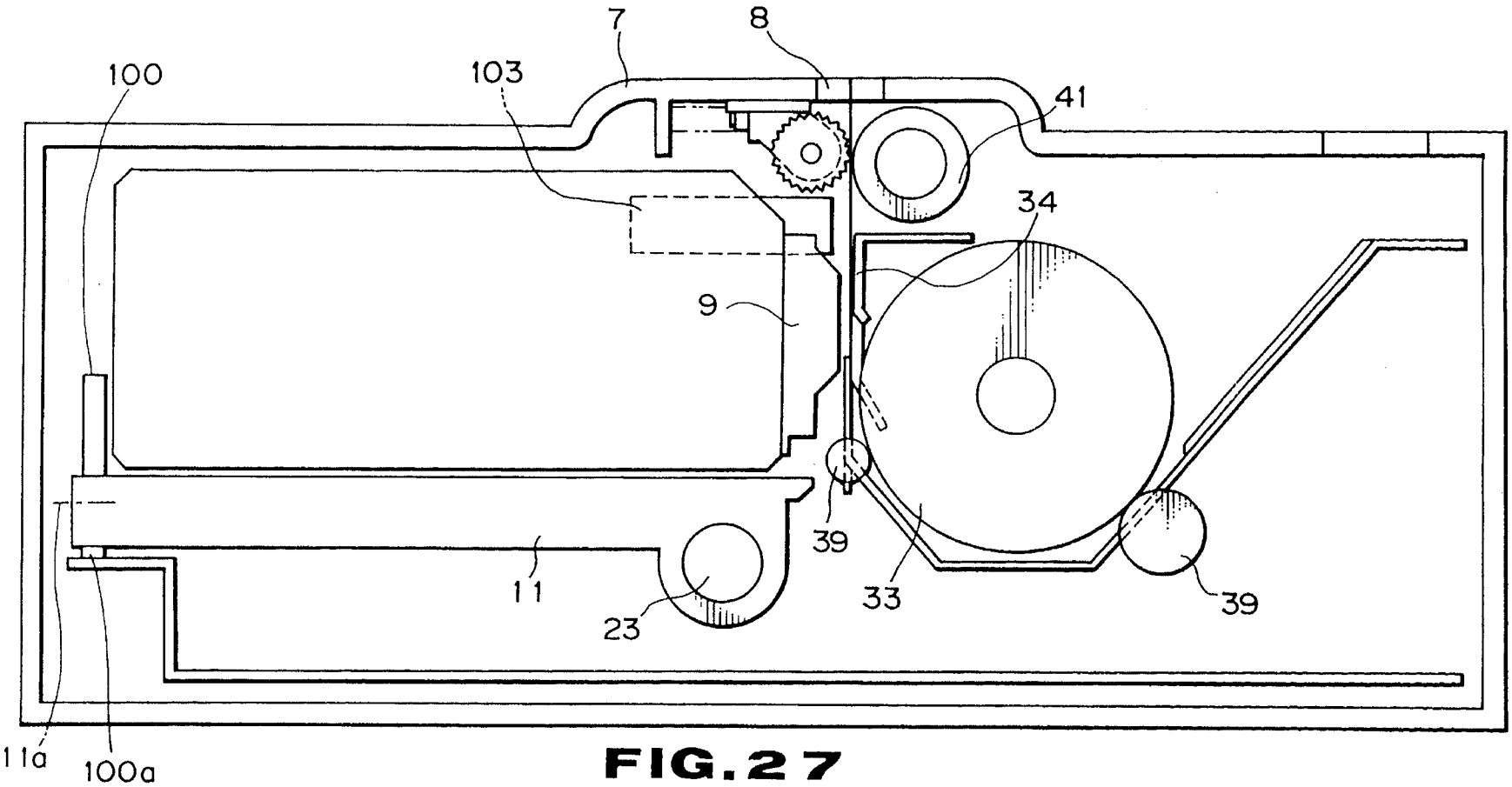
FIG. 27 is a schematic cross sectional view showing the ink jet recording apparatus related to the fifth embodiment.

The embodiment 5 shown in FIGS. 26 and 27 resolves these problems. FIG. 26 shows an example of the structure of the carriage in which a CCD 102 is mounted on the upper-stream side of the carriage in the direction "A" of moving the carriage. With the CCD 102 for recognizing directly recorded images developed on the recording medium, the following controls can be established in order to reduce the occurrence of printing errors and increase extremely the quality of recorded images;

(1) The diameter of dots is controlled to be a designated value by changing the ejection power of ink and the sequence of ejecting ink in real time in accordance with changes in the diameter of dots;

(2) The ejection timing is controlled so that the position in mounting the recording head into the cartridge, the rotational position error in defining the orifice array in the recording head and the fabrication error and component tolerance may be adjusted within or in the reference values;

(3) In case that the dot positions where ink are not ejected from their corresponding orifices are regularly detected and the number of these dots is designated number or less, ink are ejected again to these defect dot positions. In case that the dot positions where ink are not ejected from their corresponding orifices are regularly detected and the number of these dots is designated number or more, proper recovering treatment for unable orifices such as evacuating ink from these orifices is performed before starting and repeating the ordinary recording operations. In the later case, the influence of paper power sludge or dried ink sludge piled up on the surface of the recording device is considered not to be recovered naturally. Also in the later case, if the ink can not yet be ejected from the orifices even in trying to perform the recovering treatment, the above operations are tried again and repeated over, or in the worst case, the error messages are reported to the user of the recording apparatus; and (4) In case that the rotational displacement of the orifices is considered to be out of the reference value, the reason for causing this phenomena may be considered to be that for the above described unable orifices which can not eject ink, and therefore, ejection recovering treatment is tried.

By means that the CCD 103 is mounted in the lower-stream in the direction of feeding the recording sheet as shown in FIG. 27, the recorded image established in the previous scanning line and the similar controls to those described with FIG. 26 can be made for improving the quality of recording images, and also, discontinuity of characters, lines and images between adjacent scanning lines may be removed and the quality of recording images can be increased largely by controlling the ejection timing in the current line while observing the recorded images in the previous line with the CCD.

The above described structures and controls may be combined. The detector for detecting the existence of the recording medium and the detector for measuring the width of the recording medium can be substituted for a single CCD, and thus, more simplified structure of the recording apparatus can be obtained.

[Embodiment 6]

Figure 28:
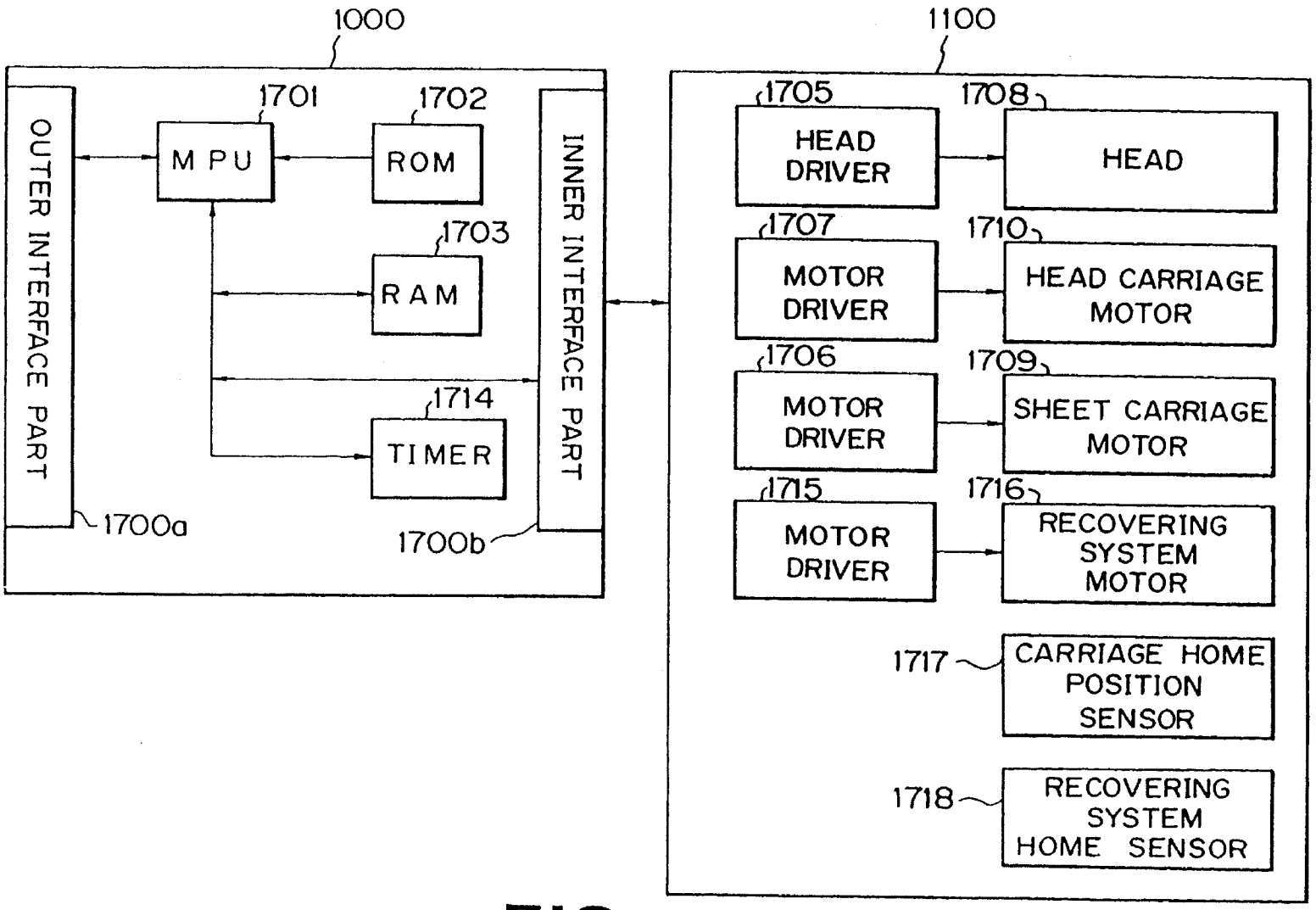
FIG. 28 is a block diagram showing an example of the structure for the control system of the recording apparatus related to the sixth embodiment of the present invention.

FIG. 28 is a block diagram showing an example of the construction of the control system of the recording apparatus using the present invention. In FIG. 28, the MPU 1701 is used for executing control procedures shown in FIGS. 29, 37 and 38 and for controlling individual blocks of the control system. The ROM 1702 stores programs corresponding to the individual control procedures. A RAM 1703 is used for work area storing temporary data in executing the control procedures. A timer 1714 counts time, an outer interface part 1700*a* is used for communicating with host systems such as computers, and an inner interface part 1700*b* is connected to a control part 1000 of the recording apparatus and a mechanical part 1100.

In the mechanical part 1100, the head driver 1705 drives the recording head 1708 according to the recording data, the motor driver 1707 drives the head carriage motor 1710 for moving to-and-fro the carriage 11 in the main-scan direction, the motor driver 1706 drives the sheet carriage motor 1709 for driving the carrier roller 33 and so on, and a motor driver 1715 drives the recovering system motor 1716 for operating the recovering system used for stabilizing the state of ejecting ink by evacuating ink stored in the nozzle of the recording head 1708 while capping the recording head 1708.

A home position sensor 1717 detects whether or not the carriage stays at the home position where the carriage is ready to move to any operations, and a recovering system home sensor 1718 detects whether or not the cap of the recovering system caps the recording head 1708.

Figure 29:
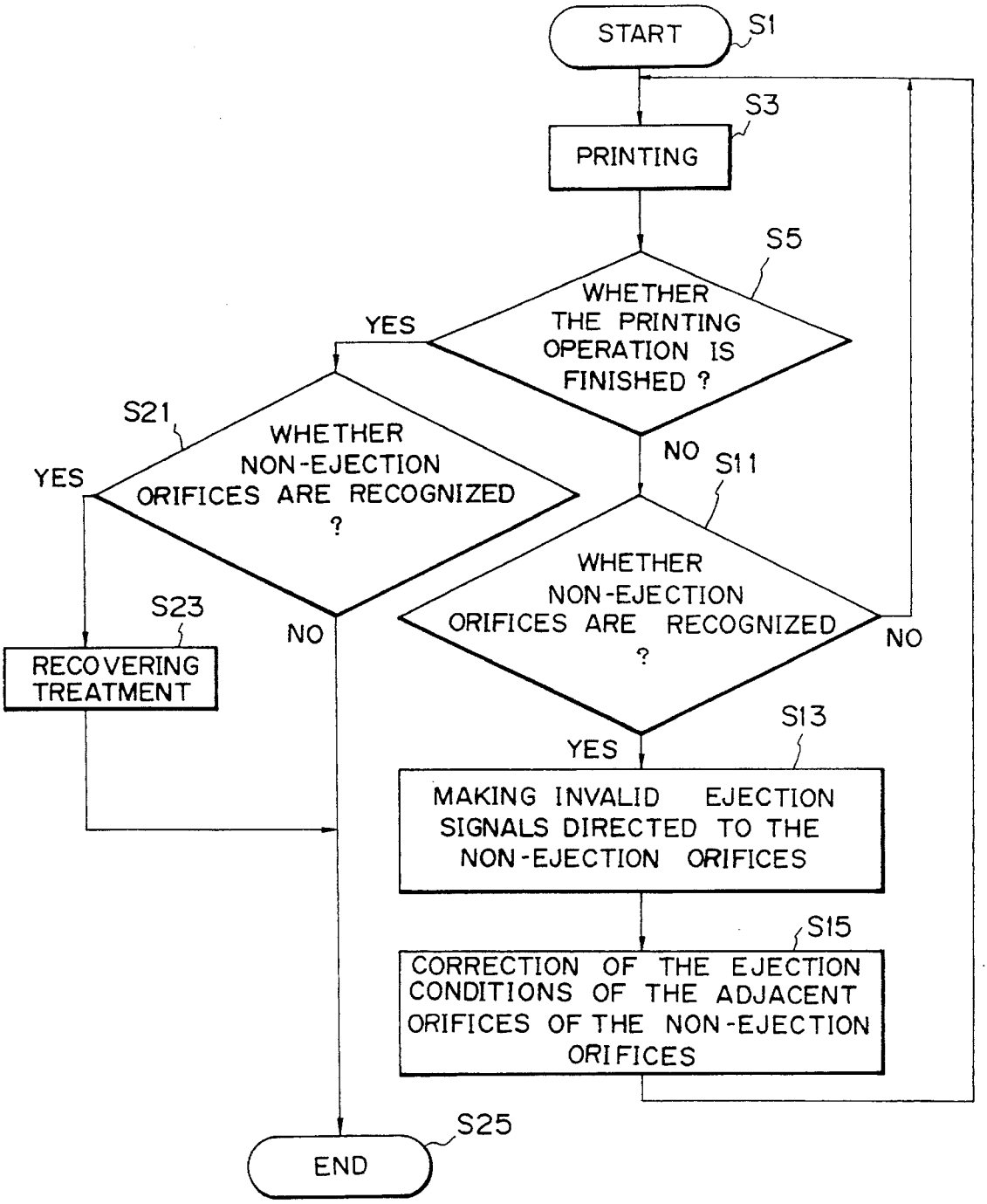
FIG. 29 is a flowchart showing an example of the correction procedure of the recording operation in the recording apparatus of the sixth embodiment of the present invention.

FIG. 29 is a flowchart showing an example of correction procedures for the printing operation in the recording apparatus of the embodiment of the present invention.

Figure 31:
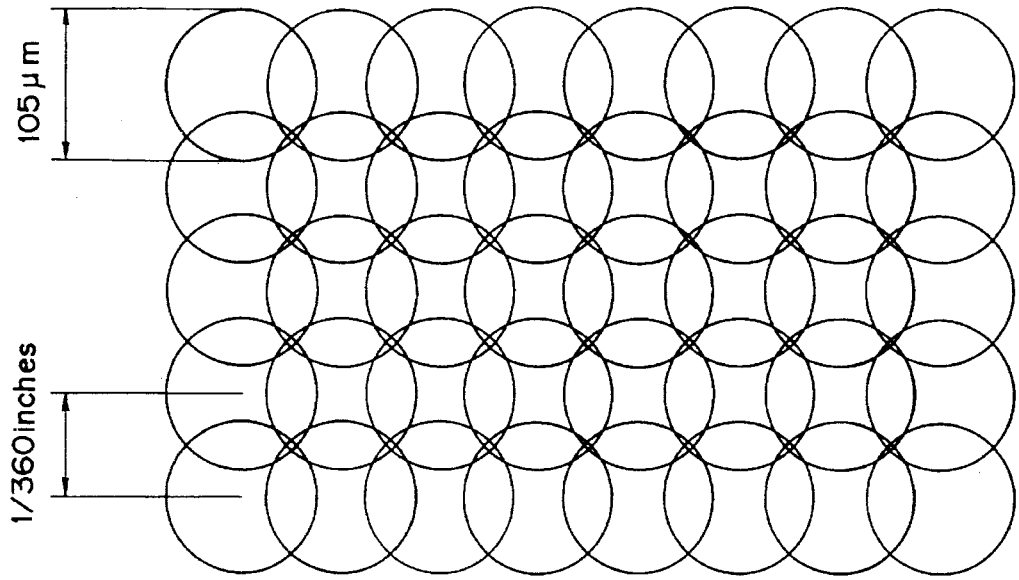
FIG. 31 is a diagram for explaining the normal dot matrix used for priority.
Figure 30:
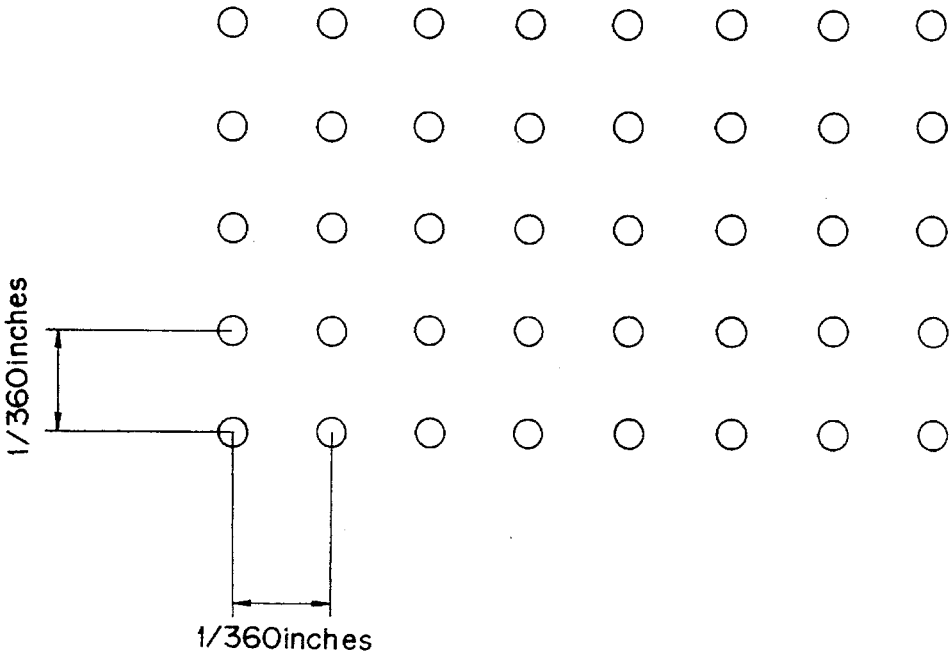
FIG. 30 is a diagram for explaining the arrangement of the orifices.

Now referring to FIGS. 29, 30 and 31, the embodiment 6 is further described in detail.

In the ink jet recording apparatus in the prior art, characters and images to be recorded are represented in terms of dot matrix composed of lattices defined by vertical and horizontal lines and their crossing points with the interval of lines, for example, being 1/360 inches as shown in FIGS. 30 and 31.

FIG. 30 shows a 200 times magnified view of the dot matrix or lattice, and FIG. 31 shows the overlapped dots, each dot having 105 μm diameter at the positions on the dot matrix defined in FIG. 30.

Figure 32:
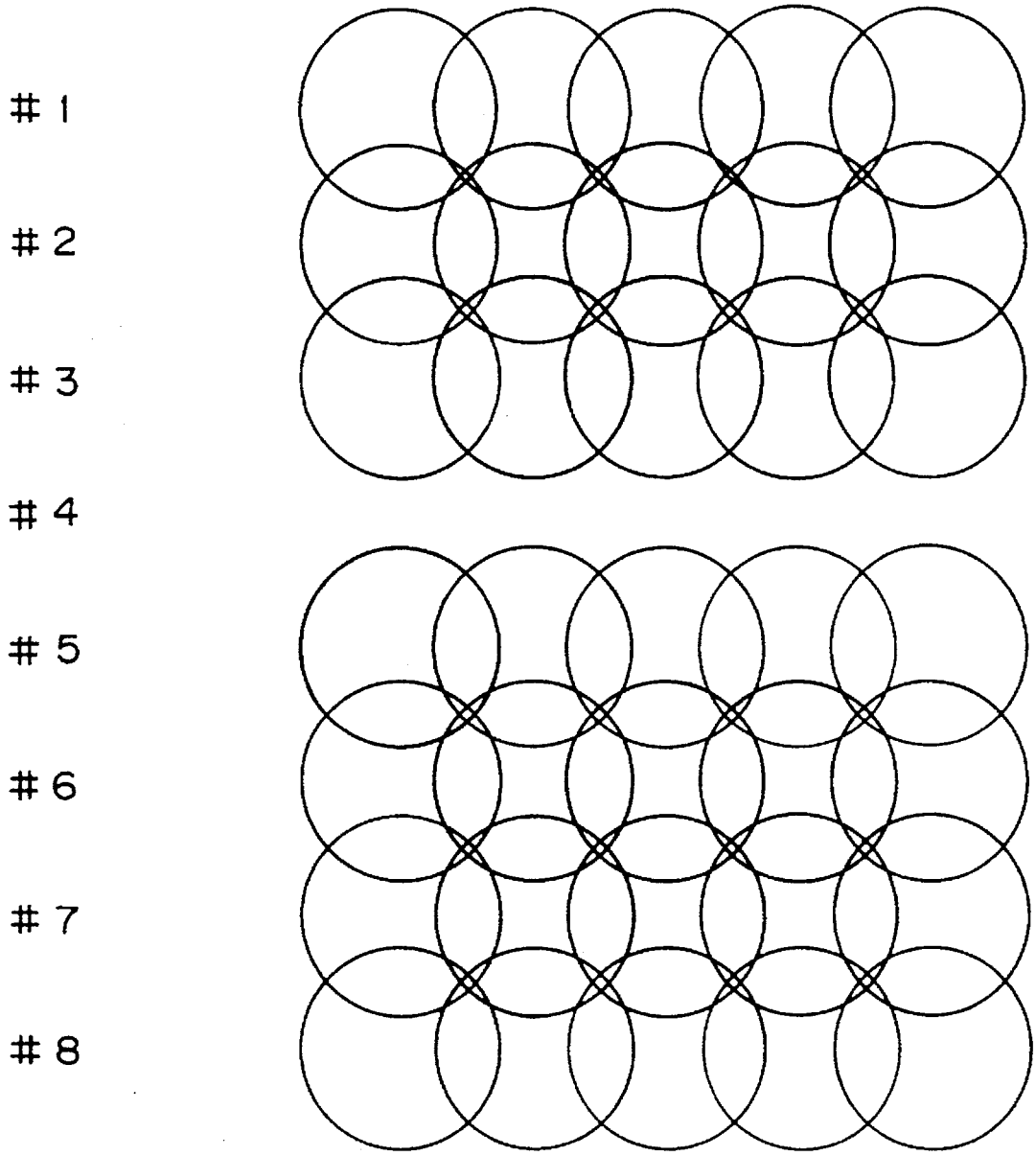
FIG. 32 is a diagram for explaining of the state of ink ejection failure in terms of dot matrix shown in FIGS. 30 and 31.

FIG. 32 shows a dot development pattern including dot defects on the generic dot matrix as defined in FIGS. 30 and 31. In FIG. 32, the detected dots are at the 4th line (#4) from the top and a blank space is found between the 3rd and 5th lines which lead to the reduction of the quality of the recorded image.

In FIG. 29, in case that the step S3 detects that ink is not ejected during the recording operation, the electric power supply for driving orifices where ink can not be ejected is disconnected in the step S13.

Next, in the step S15, the ejection conditions are corrected in order to modify the recorded image including defected dots caused by unable orifices even if continuing the recording operation.

Figure 33:
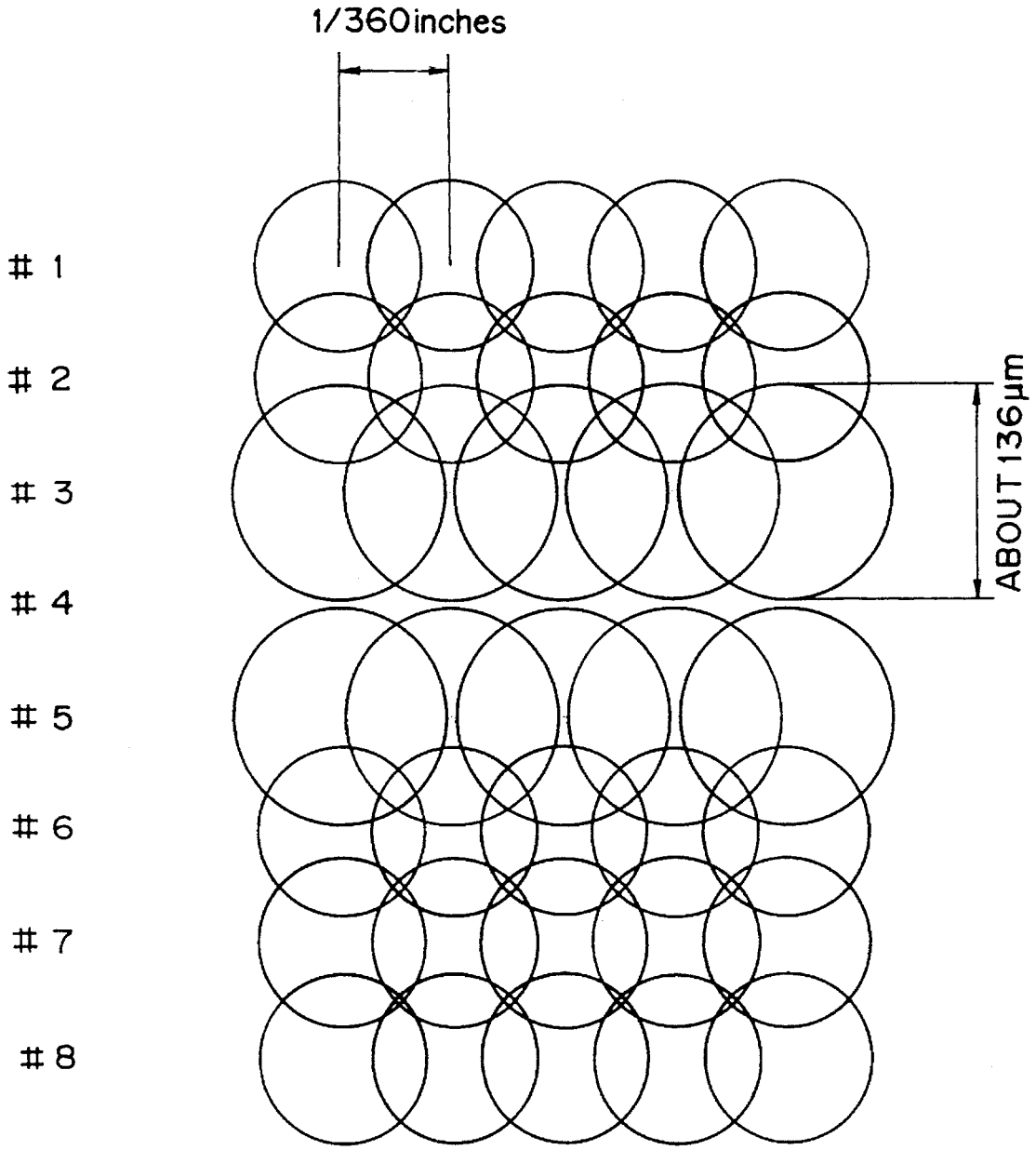
FIG. 33 is a diagram showing an example of the corrected image in the recording operation in the sixth embodiment of the recording apparatus in the present invention.

FIG. 33 shows that the defected dots on the line #4 are substituted for their adjacent dots at the lines #3 and #5 with their diameter (the diameter of ink droplets on the recording medium) being enlarged by about 30%. In FIG. 33, it is found that the blank space between the lines #3 and #5 is smaller than the blank space shown in FIG. 32.

Figure 36:
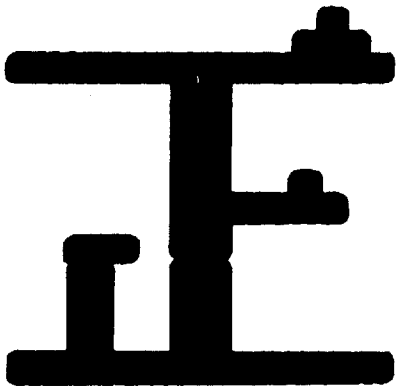
FIGS. 34, 35 and 36 are diagrams for explaining the recorded images in terms of dot matrix shown in FIGS. 31, 32 and 33, respectively.
Figure 35:
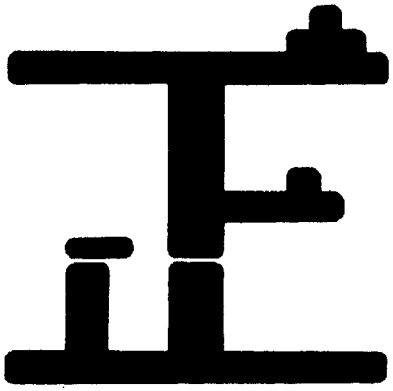
Figure 34:
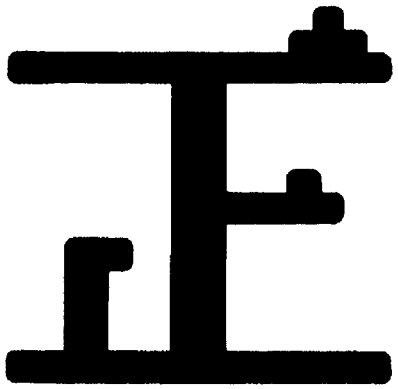

In FIGS. 34 to 36, adjusting the size of dots is explained in terms of an example of the actual character. In this embodiment, 32 orifices in the recording head are arranged in one dimensional array in the direction parallel to the sub-scan direction, and thus, a single character is composed of 32 by 32 dot matrix. FIG. 34 shows a character composed of normally recorded dots, FIG. 35 is a character composed of recorded dots including defected dot position corresponding to the orifice #22 from which ink can not be ejected, and FIG. 36 shows a character composed of recorded dots including dots with its diameter being enlarged by 30% corresponding to the orifices adjacent to the orifice #22.

If the step S5 judges that the printing operation is completed after the step S3, and next in the step S21 what is further judged is whether the printing operation has been continuing while unable orifices from which ink can not be ejected are recognized. In case that the printing operation have been continuing while unable orifices from which ink can not be ejected are recognized, printing operation is terminated in the step S25 after ejection recovering operation is performed in the step S23.

As for a means for detecting unable orifices, for example, as disclosed in Japanese Laying-Open Patent No. 6549(1992), there is a structure for detecting the state of ink by measuring electric current change in the nozzle of the recording head.

As for a means for enlarging the diameter of dots projected from the orifice, for example, as disclosed in Japanese Laying-Open Patent No. 214664(1990), there is a structure for increasing the quantity of ejected ink by modifying the ejection energy by applying additive drive pulses before the ordinary drive pulses.

[Embodiment 7]

In the embodiment 6, it is assumed that printing operation continues even when the ejection timing is controlled in case of detecting unable orifices from which ink can not be ejected. However, the present invention is not limited to this case.

Figure 37:
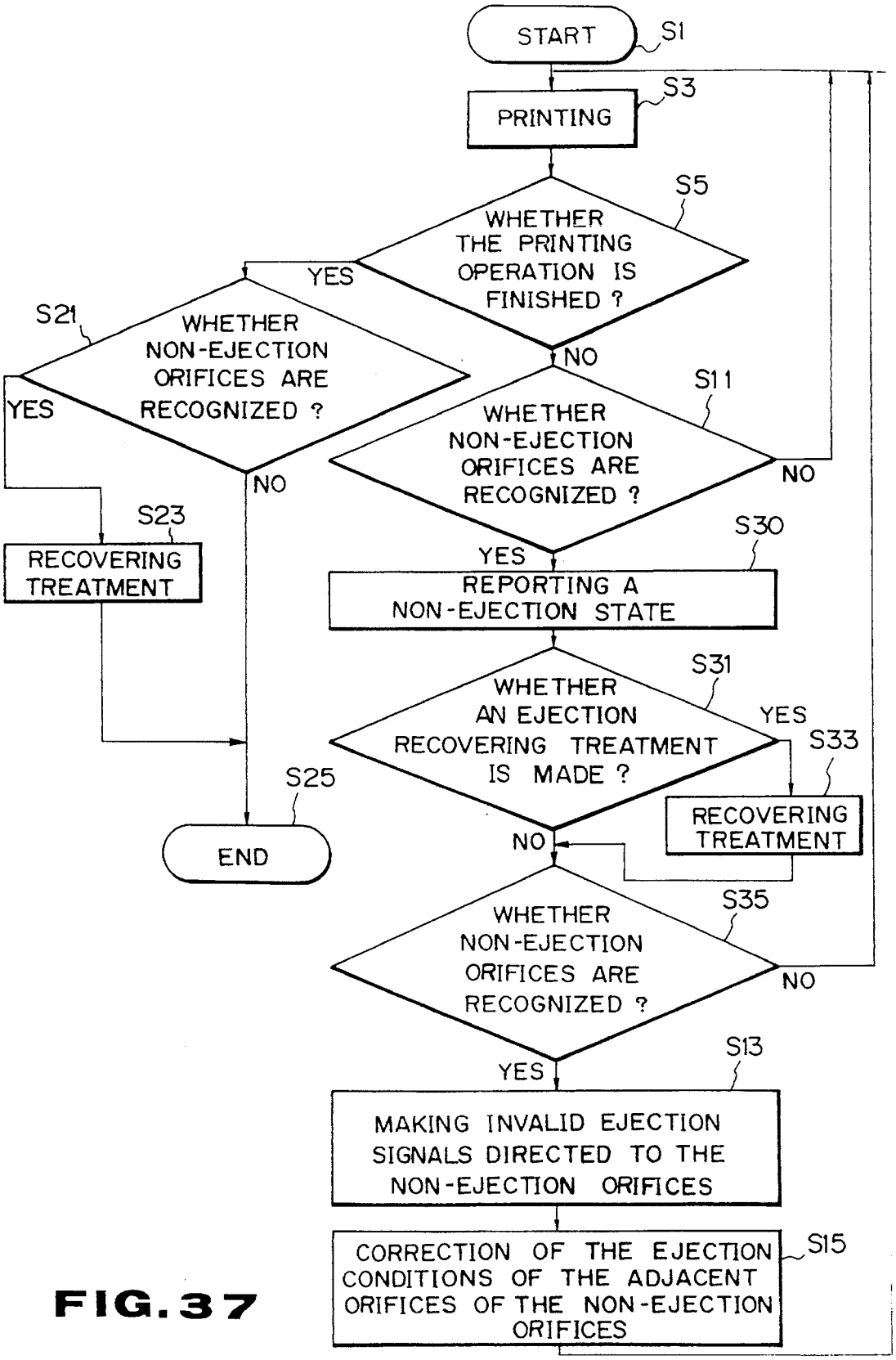
FIG. 37 is a flowchart showing an example of the correction procedure of the recording operation in the recording apparatus of the seventh embodiment of the present invention.

FIG. 37 shows a flowchart showing an example of correction procedures for the printing operation in the recording apparatus of the embodiment 7 of the present invention.

In FIG. 37, if unable orifices from which ink can not be ejected are found in the step S11 during printing operation starting from the step S3, a reporting means in the step S30 reports the fact that some unable orifice exist, and next in the step S31, what is judged is whether the printing operation continues after adjusting the ejection timing and so on or the printing operation is temporarily discontinued for performing the ejection recovering operation. If unable orifices from which ink can not be ejected are found in the step S35 even after the ejection recovering operation in the step S33, the steps S13 and S15 are selected sequentially before going back to the step S3 for restarting the printing operation.

As for the ejection recovering apparatus for performing ejection recovering operation, an example is disclosed in the Japanese Patent Application No. 156249(1991).

[Embodiment 8]

In the embodiment 7, it is assumed that the electric power supply for driving orifices where ink can not be ejected is disconnected in case of detecting unable orifices from which ink can not be ejected. However, the present invention is not limited to this case. By controlling actively for removing the state of orifices in which ink can not be ejected, it will be appreciated that what can be removed is the state of orifices in which ink can not be ejected slightly which does not require the ejection recovering operation by the above described recovering system.

Figure 38:
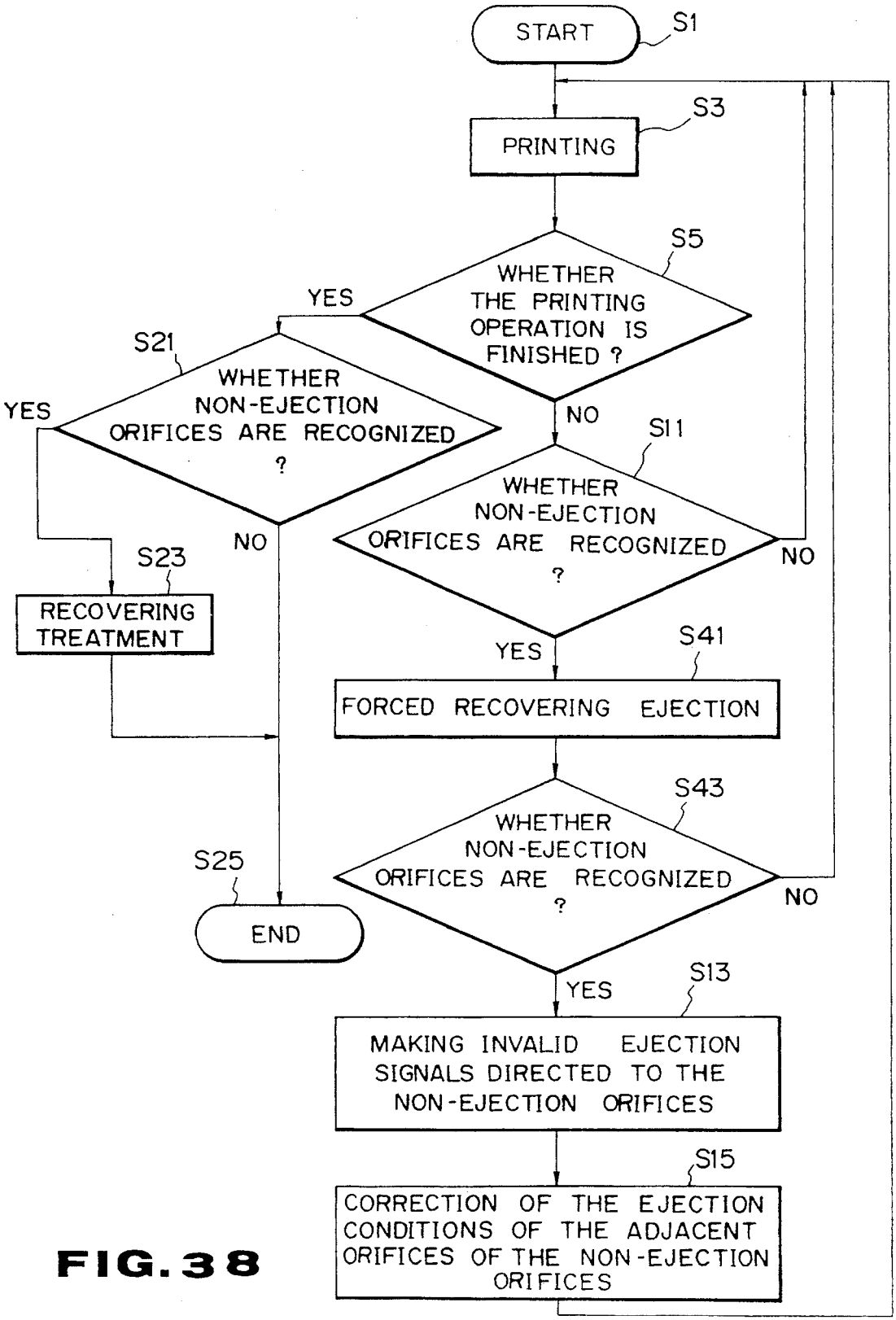
FIG. 38 is a flowchart showing an example of the correction procedure of the recording operation in the recording apparatus of the eighth embodiment of the present invention.

FIG. 38 shows a flowchart showing an example of correction procedures for the printing operation in the recording apparatus of the embodiment 8 of the present invention.

In FIG. 38, if unable orifices from which ink can not be ejected are found in the step S11 during printing operation starting from the step S3, the ejection recovering operation is forced to be executed in the step S41.

In the above described recording head, the electric power supplied to the recording head in ejecting ink is characterized by the voltage 27.6 V, the drive frequency 6.25 kHz, and it s duration time per single pulse is 4 μsec. In case of applying 1000 pulses continuously in the above described conditions, electric energy applied to a single nozzle in a unit time is several ten times as large as energy used in the ordinary recording operation, and thus, if unable orifices suffer with slight ejection failure, such failure may be removed by this forced ejection of ink with high intensity electric energy. This forced ejection of high intensity electric energy may be used as forced ejection recovering operation.

Procedures after the step S43 are identical to those in the embodiment 7.

[Embodiment 9]

In the embodiment 8, it is assumed that the detection means for ink ejection state is separately formed for detecting the state of unable orifices which can not eject ink. However, the present invention is not limited to this case. It may be allowed to define the detection means for the quantity of ink remained in the recording head or the ink cartridge tank as a detection means for ink ejection state.

Figure 39:
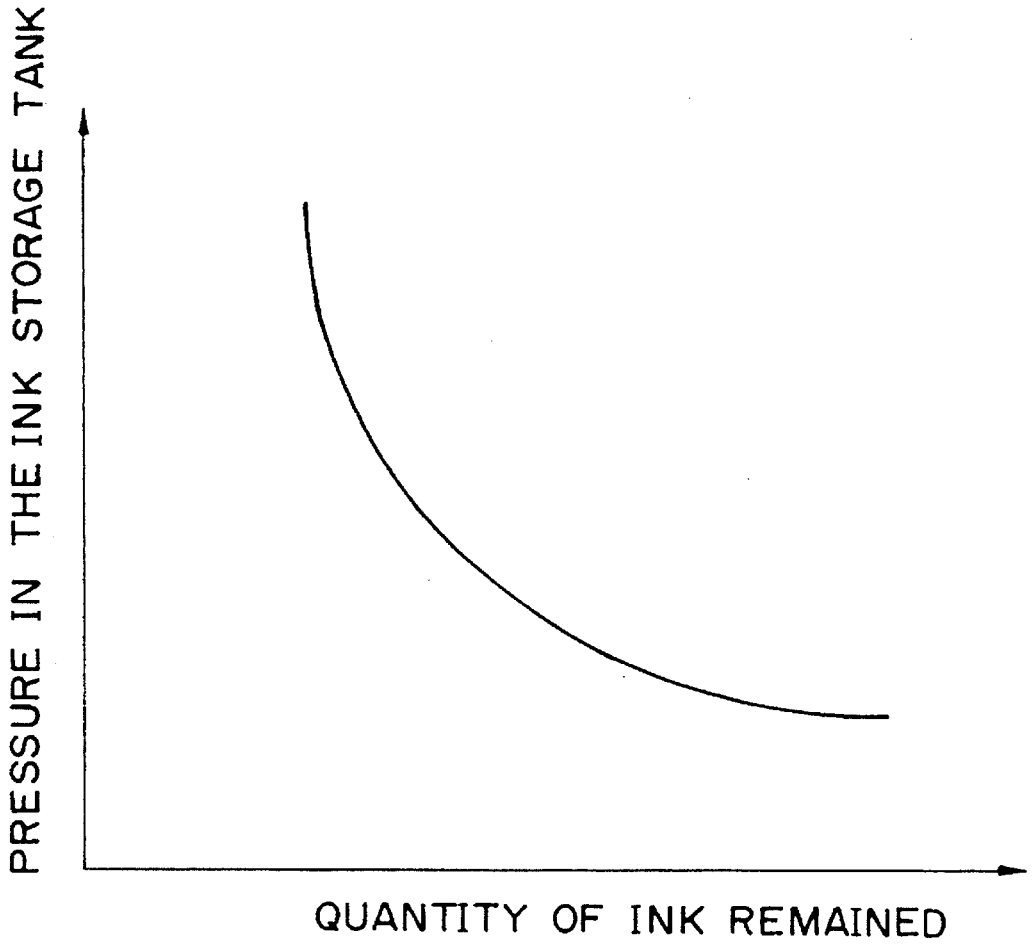
FIG. 39 is a diagram showing a correlation between the quantity of ink remained in the head cartridge and the pressure in the ink storage tank of the head cartridge in the recording apparatus of the ninth embodiment of the present invention.

FIG. 39 shows a correlation between the quantity of ink remained in the tank and the pressure in the tank in the head cartridge of the embodiment 9 of the present invention. In this embodiment, what is used is the structure of the head cartridge in which negative pressure is applied in the cartridge in order to capture ink within the head cartridge without leakage no matter where the orifices of the recording head direct.

In FIG. 39, it is found that, as the quantity of ink remained in the cartridge decreases, the negative pressure in the tank increases. This means that, as the quantity of ink decreases in the tank, the force to be used for keeping ink within the tank increases, and thus, in case of ejecting a constant amount of ink regularly, it may be possible to increase the ink ejection energy as the negative pressure in the tank increases.

A means for adjusting the ink ejection energy is disclosed in the previous embodiments.

In case of applying a detection means for the quantity of ink remained in the ink cartridge as a means for ink ejection state, it may be allowed to use the technology disclosed, for example, in Japanese Laying-Open Patent No. 44548(1988).

In the above mentioned embodiments, it is assumed that the dot matrix is composed of lattice including vertical and horizontal lines with their lattice pitch being 1/360 inches. The present invention is not limited to this dimension of the dot matrix. Specifically, in case of using a fine dot matrix having a lattice pitch less than 1/360 inches, the expansion rate for the modified diameter of dots adjacent to defected dot positions required for covering up the defected dot positions can be taken to be less than 30% defined in the above mentioned embodiments, which leads to the reduction of energy to be applied to the recording devices and ultimately to the reduction of overall electric energy consumption and heat generation.

In the above mentioned embodiments, it is assumed that recording apparatus uses a recording head based on bubble jet ejection method. However, the present invention is not limited to this case, but applicable to many kinds of recording apparatuses using another ink jet method using ink in liquid or solid, thermal recording method, and heat transfer printing method in which the driving method of recording devices may be selected from serial method, line method and more. In either case mentioned above, technical improvement disclosed in the above embodiments can be commonly established.

In case of recording information with a recording head having a plurality of recording devices, if applying electric power to be used for recording in spite of the fact that the recording device can not record information, it is easily concluded that electric power to be used for recording may cause bad effects to recording devices adjacent to its generically designated device. It is also apparent that this conclusion may be applicable commonly to those technologies for various kinds of recording methods mentioned above.

In the embodiments 1 and 2, the single recording head has 64 nozzles and its recording density is 360 dpi, and the cross section of the recording sheet within the recording area has the length 4.4 mm equivalent to the extended length between the nozzle #1 and the nozzle #64. In case that using the recording head having a plurality of nozzles extended in a longer recording area and that the cross section of the recording sheet within such an extended recording area is not shaped in a straight line, the embodiment 1 can be applicable by modifying the correction table and the embodiment 2 can be applicable by detecting the displacement of the recording position at a plurality of points between the uppermost dot and the lowermost dot, both cases of which will be appreciated to bring the same effect as the embodiments 1 and 2.

As described above, it is possible to provide a recording apparatus generating high-quality recording images by means that the species of the recording medium, the recording position, the environmental temperature and humidity, and the distance between the recording means and the recording sheet are detected directly or specified outside, that the ejection timing for the individual recording dots is adjusted, and that the displacement of the recording position due to the distance between the recording means and the recording medium at the recording area.

In the embodiments 1 and 2, the ejection timing is adjusted every time when the individual single line is recorded. The present invention may be applicable to such cases that a plurality of ejection timings can be adjusted in recording the individual single line and that a single ejection timing is adjusted for a plurality of recording lines. In either case, the effect brought by the embodiments 1 and 2 can be expected.

In addition, the correction operation may be directed to the operator who may interact with the operation panel of the recording apparatus through which the output result from the recording apparatus is observed and correction commands may be specified by the dip switch and the keyboard interactively, and thus, this may bring the same effect by the embodiments 1 and 2.

Though, in the above embodiments, the recording dots are formed by block by the recording apparatus using ink jet recording method and by applying electric power to the recording devices by group, the present invention is not limited to this case. The present invention can accept such cases that the recording devices are driven without considering groups, and that general technologies used in the recording apparatus use a non-impact printing method.

It may be allowed to perform higher quality recording images by combining some of the above described embodiments.

The present invention may be applicable to a system composed of a plurality of components or applicable to an apparatus comprising a single component. In addition, the present invention is applicable to the case of realizing the function of the system or the apparatus by supplying software programs to the system or the apparatus.

As described above, according to the present invention, by detecting or estimating the recording state during the recording operation, and by adjusting the recording timing based on the recognized recording state, and by reporting some specific messages to the user in case of abnormal states in recording operation, it will be appreciated that high quality recording images can be established and that a recording apparatus without causing recording errors can be provided.

The present invention has been described in detail with respect to preferred embodiments, and it will now be that changes and modifications may be made without departing from the invention in its broader aspects, and it is the intention, therefore, in the appended claims to cover all such changes and modifications as fall within the true spirit of the invention.

What is claimed is:

1. A recording apparatus for performing recording on a recording medium with a recording portion including a recording head having a plurality of recording elements, said apparatus comprising:

information acquisition means for acquiring a first distance between the recording medium and an upper positioned recording element, and a second distance between the recording medium and a lower positioned recording element;

establishment means for establishing a correction value for ink ejection timing of said recording head on the basis of the difference between the first distance and the second distance acquired by said information acquisition means; and control means for controlling said recording portion to record on the basis of the correction value for ink ejection timing established by said establishment means.

2. A recording apparatus as claimed in claim 1, further comprising:

means for judging whether or not recording is able to be performed by said recording elements on the basis of the correction value provided by said establishment means; and second establishment means for establishing a slower recording speed of said recording elements when judged by said judgement means that recording is not able to be performed.

3. A recording apparatus as claimed in claim 1, wherein said recording head ejects ink by using thermal energy, and said recording elements comprise thermal energy conversion members for generating thermal energy to be transferred to the ink.

4. A recording apparatus as claimed in claim 1, wherein said information acquisition means comprises a sensor.

5. A recording method for performing recording on a recording medium with a recording portion including a recording head having a plurality of recording elements, said method comprising the steps of:

acquiring a first distance between the recording medium and an upper positioned recording element, and a second distance between the recording medium and a lower positioned recording element;

establishing a correction value for ink ejection timing of said recording head on the basis of the difference between the first distance and the second distance acquired in said acquiring step; and controlling said recording portion to record on the basis of the correction value for ink ejection timing established in said establishing step.

6. A recording method as claimed in claim 5, further comprising the steps of:

judging whether or not recording is able to be performed by said recording elements on the basis of the correction value provided in said establishing step; and establishing a slower recording speed of said recording elements when judged in said judging step that recording is not able to be performed.

7. A recording method as claimed in claim 5, wherein said recording head ejects ink by using thermal energy, and said recording elements comprise thermal energy conversion members for generating thermal energy to be transferred to the ink.

8. A recording method as claimed in claim 5, wherein a sensor is utilized in said information acquiring step.

9. A recording apparatus for recording information with a recording head having a plurality of recording elements while keeping a designated distance between said recording head and a recording medium, said apparatus comprising:

information acquisition means for acquiring distance information between said plurality of recording elements and said recording medium;

correction means for providing a correction value for a recording timing for each recording element of said plurality of recording elements of said recording head in accordance with said distance information acquired by said information acquisition means; and control means for controlling said recording head to record at a timing corrected with said correction value provided by said correction means, wherein said correction means corrects said recording timing based on a correction value obtained from a correction table by specifying a print duty up to a previous line, a print duty up to a current recording line, information on an order of repeated path, and a lapse of time after a previous path in said correction table.

* * * * *

UNITED STATES PATENT AND TRADEMARK OFFICE

CERTIFICATE OF CORRECTION

PATENT NO. : 5,576,744 Page 1 of 6

DATED : November 19, 1996

INVENTOR(S) : Takeji NIIKURA, et al.

It is certified that error appears in the above-indentified patent and that said Letters Patent is hereby corrected as shown below:

IN THE DRAWING SHEETS:

Sheet 23 of 36:

"DETEMINING" should read --DETERMINING--.

IN THE DISCLOSURE:

COLUMN 1:

Line 31, "apparatus" should read --apparatuses--.

COLUMN 3:

Line 61, "man-scan" should read --main-scan--.

COLUMN 4:

Line 9, "factors;" should read --factors:--;
Line 11, "professing;" should read --processing;--;
Line 14, "storage, expected" should read --storage. Often, the expected--.

UNITED STATES PATENT AND TRADEMARK OFFICE

CERTIFICATE OF CORRECTION

PATENT NO. : 5,576,744 Page 2 of 6

DATED : November 19, 1996

INVENTOR(S) : Takeji NIIKURA, et al.

It is certified that error appears in the above-indentified patent and that said Letters Patent is hereby corrected as shown below:

COLUMN 5:

Line 16 , "is" should read --is to--;
Line 65, "correct ion" should read --correction--.

COLUMN 6:

Line 23, "the" should be deleted.

COLUMN 8:

Line 5, "cartage;" should read --cartridge;--;
Line 16, "invent ion;" should read --invention;--.

COLUMN 9:

Line 61, "64" should read --64--;
Line 67, "pulley" should read --pulleys--.

UNITED STATES PATENT AND TRADEMARK OFFICE

CERTIFICATE OF CORRECTION

PATENT NO. : 5,576,744 Page 3 of 6

DATED : November 19, 1996

INVENTOR(S) : Takeji NIIKURA, et al.

It is certified that error appears in the above-indentified patent and that said Letters Patent is hereby corrected as shown below:

COLUMN 11:

Line 67, "for" should be deleted.

COLUMN 12:

Line 41, "in" should be deleted;
Line 60, "more" should read --move--.

COLUMN 14:

Line 46, "has" should read --have--;
Line 67, "species the" should read --species of the--.

COLUMN 15:

Line 18, "sheet." should read --sheet can be compensated.--;
Line 20, "are" should read --is--;
Line 23, "are" should read --is--.

UNITED STATES PATENT AND TRADEMARK OFFICE

CERTIFICATE OF CORRECTION

PATENT NO. : 5,576,744

DATED : November 19, 1996

INVENTOR(S) : Takeji NIIKURA, et al.

It is certified that error appears in the above-indentified patent and that said Letters Patent is hereby corrected as shown below:

COLUMN 16:

Line 1, "lower" should be deleted and "make" should read --enable--;
Line 2, "enable" should be deleted;
Line 30, "primitive" should read --primary--.

COLUMN 17:

Line 1, "as" should be deleted.

COLUMN 18:

Line 8, "enable" should read --be able--.

COLUMN 19:

Line 20, "ink" should read --ink droplets--;
Line 23, "ink" should read --ink droplets--;
Line 24, "ink" should read --ink droplets--;
Line 31, "power" should read --powder--.

UNITED STATES PATENT AND TRADEMARK OFFICE

CERTIFICATE OF CORRECTION

PATENT NO. : 5,576,744 Page 5 of 6

DATED : November 19, 1996

INVENTOR(S) : Takeji NIIKURA, et al.

It is certified that error appears in the above-indentified patent and that said Letters Patent is hereby corrected as shown below:

COLUMN 20:

Line 50, "defected" should read --defective--;
Line 53, "defected" should read --defective--;
Line 66, "defected" should read --defective--.

COLUMN 21:

Line 2, "its diameter" should read --their diameters--;
Line 9, "have" should read --has--;
Line 36, "orifice" should read --orifices--.

COLUMN 22:

Line 2, "it s" should read --its--;
Line 48, "defected" should read --defective--;
Line 49, "defected" should read --defective--;
Line 63, "either" should read --any--.

UNITED STATES PATENT AND TRADEMARK OFFICE

CERTIFICATE OF CORRECTION

PATENT NO. : 5,576,744 Page 6 of 6

DATED : November 19, 1996

INVENTOR(S) : Takeji NIIKURA, et al.

It is certified that error appears in the above-indentified patent and that said Letters Patent is hereby corrected as shown below:

COLUMN 23:

Line 32, "area." should read --area is controlled.--;

Line 46, "by" should read --as--.

COLUMN 24:

Line 8, "be that" should read --be seen that--.

Signed and Sealed this

Third Day of June, 1997

Attest:

Bruce Lehman

BRUCE LEHMAN

Attesting Officer

Commissioner of Patents and Trademarks